US005896933A

United States Patent [19]

White

[11] Patent Number: 5,896,933

[45] Date of Patent: Apr. 27, 1999

[54] FASTENER DRIVING DEVICE HAVING INTERCHANGEABLE CONTROL MODULES

[75] Inventor: Brian M. White, Riverside, R.I.

[73] Assignee: Stanley Fastening Systems, L.P., East Greenwich, R.I.

[21] Appl. No.: 08/852,080

[22] Filed: May 6, 1997

Related U.S. Application Data

[63] Continuation-in-part of application No. 08/559,240, Nov. 16, 1995, Pat. No. 5,628,444, application No. 08/568,539, May 17, 1996, Pat. No. 5,669,542, and application No. 08/650,142, Dec. 7, 1995, Pat. No. 5,829,660.

[51] Int. Cl.[6] ..... B25C 1/04

[52] U.S. Cl. ..... 227/130; 227/8; 91/308

[58] Field of Search ..... 227/130, 8; 91/307, 91/308, 309, 321, 274

[56] References Cited

U.S. PATENT DOCUMENTS

| | | | |
|---|---|---|---|
| 3,583,496 | 6/1971 | Fehrs . | |
| 4,550,643 | 11/1985 | Schwartzenberger . | |
| 5,080,273 | 1/1992 | Meyer | 227/130 |
| 5,083,694 | 1/1992 | Lemos | 227/8 |
| 5,522,532 | 6/1996 | Chen | 227/130 |
| 5,628,444 | 5/1997 | White | 227/130 |
| 5,785,228 | 7/1998 | Fa et al. | 227/130 |

FOREIGN PATENT DOCUMENTS

| | | |
|---|---|---|
| 0774327 A1 | 5/1997 | European Pat. Off. . |
| 0774328 A1 | 5/1997 | European Pat. Off. . |
| 0778109 A1 | 6/1997 | European Pat. Off. . |
| 8801114 | 5/1988 | Germany . |

*Primary Examiner*—Scott A. Smith
*Attorney, Agent, or Firm*—Pillsbury Madison & Sutro, L.L.P.

[57] ABSTRACT

A pneumatically operated fastener driving device which includes a control valve module having i) a control module housing assembly mounted with respect to the housing and providing an exhaust passage which can be opened to communicate the one end of the cylinder with atmosphere, and ii) a main valve mounted with respect to the control module housing assembly for movement between opened and closed positions to open and close the passageway. The control module is a selected one of the standard type, full cycle type, automatic type, and automatic with remote type. The selected one control module is constructed and arranged with respect to the main frame portion of the housing so as to be removable therefrom as a unit. After removal of the selected one control module as a unit, another one of the types of control modules can be positioned with respect to the main frame portion of the housing as a unit to as to be operable therewith.

22 Claims, 16 Drawing Sheets

FASTENER DRIVING DEVICE HAVING INTERCHANGEABLE CONTROL MODULES

This application is a continuation-in-part of Ser. Nos. 08/559,240, filed Nov. 16, 1995, now U.S. Pat. No. 5,628,444, a continuation-in-part of 08/568,539, filed May 17, 1996, now U.S. Pat. No. 5,669,542, and a continuation-in-part of 08/650,142, filed Dec. 7, 1995, now U.S. Pat. No. 5,829,660, which are hereby incorporated by reference.

BACKGROUND OF THE INVENTION

This invention relates to a fastener driving device and, more particularly, to an air operated fastener driving device having interchangeable control modules.

A conventional fastener driving device typically includes a main valve disposed above a cylinder sleeve which houses a piston and cylinder unit. The main valve is pilot pressure operated and movable from a closed position to an opened position permitting air under pressure to communicate with the piston and cylinder unit for initiating a fastener drive stroke. This main valve/sleeve valve arrangement has proven to be efficient, but adds to the overall height of the device, which may be unacceptable for certain applications.

It is also known that conventional fastener driving devices may be one of several types. In accordance with a first type of driving device, conventionally referred to as one containing a "standard" valve arrangement, the piston undergoes a fastener impacting stroke upon actuation of the trigger. In this device, the piston does not return to its initial or upper position until after the trigger is released.

Although the standard device is appropriate for certain applications, the operator may actuate the trigger longer than needed to drive a fastener which causes air over the piston to increase. This pressure may reach line pressure. Thus, the high pressure over the piston must be exhausted during the return stoke of the piston which tends to be noisy. Further, air consumption is high with trigger fire tools due to having to exhaust such high pressures. In addition, since high pressure may be unnecessarily applied to the piston which contacts a bumper of the tool at the end of the drive stroke, bumper life is reduced.

With trigger fire tools, if the operator actuates the trigger longer than needed, the driving element remains exposed or extending from the nose piece of the tool. When the operator moves from one position to another, the tip of the fastener driving element may be damaged or broken. Still further, if the tool is an upholstery tool, the exposed tip of the fastener driving element may catch on the upholstery and thereby damage the fabric.

A second type of fastener driving device, know as a device having a "full cycle" valve arrangement, has been developed such that one full cycle (a single full cycle) of operation of the tool is completed while the trigger remains actuated. Thus, air over the piston remains relatively low, less than line pressure. This reduces noise and increases bumper life. Further, the fastener driving element is only exposed from the nose piece for a very short time, which eliminates the above-mentioned problems.

There also exists a third type of fastener driving devices, which operates in an automatic mode. To operate the driving device in an automatic mode of operation, a pressure responsive secondary valve is typically provided. With this arrangement, when a manually operable trigger is actuated and held, the main valve and the secondary valve operate alternately to intake air into the piston chamber and subsequently discharge the air therefrom, so that the movement of the piston and fastener driving element is repeated.

A fourth fastener driving device can be remotely operated by coupling the device in appropriate fashion to a remote actuating unit the provides alternating high and low pressure signals for generating alternating fastener drive strokes and return strokes.

A limitation with each of these fastener driving tools is that they are constructed to operate in a single mode only and cannot be easily adapted to operate in two or more modes. Since there are some instances when an operator would like to change the mode of operation, there exists a need to provide a fastener driving device which can be easily and efficiently converted between the different modes of operation.

SUMMARY OF THE INVENTION

It is an object of the present invention to fulfill the need expressed above. In accordance with the principles of the invention there is provided a pneumatically operated fastener driving device comprising: a housing, a fastener drive track disposed within the housing, a fastener magazine for feeding successive fasteners laterally into the drive track, a fastener driving element slidably mounted in the drive track for movement through an operative cycle including a drive stroke during which a fastener within the drive track is engaged and moved longitudinally outwardly of the drive track into a workpiece and a return stroke, and a drive piston connected with the fastener driving element. A cylinder, defined in the housing, reciprocally mounts the piston, and an air pressure reservoir communicates with one end of the cylinder through a passageway. Also included is a control module for opening the passageway and communicating reservoir pressure with the cylinder at the one end thereof to move the piston in a direction to effect the drive stroke of the fastener driving element and for closing the passageway and communicating the one end of the cylinder with atmosphere for permitting the piston to move in a direction to effect the return stroke of the fastener driving element, the control valve module including i) a control module housing assembly mounted with respect to the housing and providing an exhaust passage which can be opened to communicate the one end of the cylinder with atmosphere, and ii) a main valve mounted with respect to the control module housing assembly for movement between opened and closed positions to open and close the passageway. The control module is operable to effect movement of the fastener driving element from an initial position through a fastener drive stroke, and though a return stroke wherein said fastener driving element returns to said initial position. The control module is selected one of the following types: a) a first type of control module having a trigger assembly operable to effect movement of the fastener driving element from the initial position through one fastener drive stroke upon movement of the trigger assembly from the normal inoperative position into the operating position, and wherein upon return of the trigger assembly from the operating position to the normal inoperative position the fastener driving element moves though the return stroke wherein the fastener driving element returns to the initial position, b) a second type of control module having a trigger assembly operable to effect movement of the fastener driving element through one full cycle fastener driving stroke including the fastener drive stroke and the return stroke upon movement of the trigger assembly from the normal inoperative position into the operating position, c) a third type of control module having a trigger assembly operable to effect movement of the fastener driving element through a plurality of alternating fastener drive strokes and return strokes upon movement of the trigger assembly from the normal inoperative position into the operating position, and to terminate the alternating fastener drive strokes and return strokes upon movement of the trigger assembly from the operating position to the normal inoperative position, d) a fourth type of control module which is devoid of a trigger assembly and constructed and arranged to be connected with a remote actuation unit providing alternating high and low pressure signals to effect alternating fastener drive strokes and return strokes. The selected one control module is constructed and arranged with respect to the main frame portion of the housing so as to be removable therefrom as a unit. After removal of the selected one control module as a unit, another one of the types of control modules can be positioned with respect to the main frame portion of the housing as a unit to as to be operable therewith.

In a preferred embodiment, there is provided a pneumatically operated fastener driving device comprising a housing having a tubular housing portion and a main frame portion extending laterally from the tubular housing portion, the tubular housing portion defining a fastener drive track, a fastener magazine for feeding successive fasteners laterally into the drive track, a fastener driving element slidably mounted in the drive track for movement through an operative cycle including a drive stroke during which a fastener within the drive track is engaged and moved longitudinally outwardly of the drive track into a workpiece and a return stroke, a drive piston connected with the fastener driving element, a cylinder, defined in the tubular housing portion, within which the piston is reciprocally mounted, an air pressure reservoir communicating with one end of the cylinder through a passageway, a control module for opening the passageway and communicating reservoir pressure with the cylinder at the one end thereof to move the piston in a direction to effect the drive stroke of the fastener driving element and for closing the passageway and communicating the one end of the cylinder with atmosphere for permitting the piston to move in a direction to effect the return stroke of the fastener driving element, the control valve module including: a control module housing assembly mounted with respect to the main frame portion of the housing and providing an exhaust passage which can be opened to communicate the one end of the cylinder with atmosphere, a main valve mounted with respect to the control module housing assembly for movement between opened and closed positions to open and close the passageway, the main valve having a first pressure area defining with a portion of the control module housing assembly a control pressure chamber, the main valve including a second pressure area in opposing relation to the first pressure area, spring structure biasing the main valve towards its closed position, exhaust seal structure fixed to the control module housing assembly, the exhaust seal being operatively associated with the main valve for closing the exhaust passage when the main valve is disposed in its opened position, an actuating member mounted with respect to the control module housing assembly and being constructed and arranged to move from a normal, sealed position into an operative, unsealed position for initiating movement of the main valve to its opened position thereby opening the passageway and initiating movement of the fastener driving element through a fastener drive stroke, and a trigger assembly mounted with respect to the control module housing assembly for movement from a normal, inoperative position into an operating position, such that movement of the trigger assembly from its inoperative position to its operating position moves the actuating member from its normal, sealed position to its operative, unsealed position, the actuating member controlling pressure in the control pressure chamber such that when the actuating member is in its operative, unsealed position, pressure in the control pressure chamber acting on the first pressure area is released to atmosphere and pressure acting on the second pressure area moves the main valve against the bias of the spring structure to its opened position initiating a fastener drive stroke, the main valve engaging the exhaust seal structure when the main valve is in its opened position thereby closing the exhaust passage and preventing the one end of the cylinder to communicate with atmosphere. The control module is operable to effect movement of said fastener driving element from an initial position through a fastener drive stroke, and though a return stroke wherein said fastener driving element returns to said initial position after said fastener drive stroke, said control module being a selected one of the following types: a) a first type of control module operable to effect movement of the fastener driving element from the initial position through one said fastener drive stroke upon movement of said trigger assembly from the normal inoperative position into the operating position, and wherein upon return of the trigger assembly from said operating position to said normal inoperative position the fastener driving element moves though the return stroke wherein the fastener driving element returns to the initial position, b) a second type of control module operable to effect movement of the fastener driving element through one full cycle fastener driving stroke including the fastener drive stroke and the return stroke upon movement of the trigger assembly from the normal inoperative position into the operating position, c) a third type of control module operable to effect movement of the fastener driving element through a plurality of alternating fastener drive strokes and return strokes upon movement of said trigger assembly from the normal inoperative position into the operating position, and to terminate the alternating fastener drive strokes and return strokes upon movement of the trigger assembly from the operating position to the normal inoperative position, d) a fourth type of control module constructed and arranged to be connected with a remote actuation unit providing alternating high and low pressure signals to said fourth type of control module to effect alternating fastener drive strokes and return strokes. The selected one control module is constructed and arranged with respect to the main frame portion of the housing so as to be removable therefrom as a unit, and wherein after removal of the selected one control module as a unit, another one of the types of control modules can be positioned with respect to the main frame portion of the housing as a unit to as to be operable therewith.

The interchangeable control modules are easily inserted or removed from the main frame portion of the housing.

These and other objects of the present invention will become apparent during the course of the following detailed description and appended claims.

The invention may be best understood with reference to the accompanying drawings wherein an illustrative embodiment is shown.

IN THE DRAWINGS

DETAILED DESCRIPTION OF THE INVENTION

Figure 1:
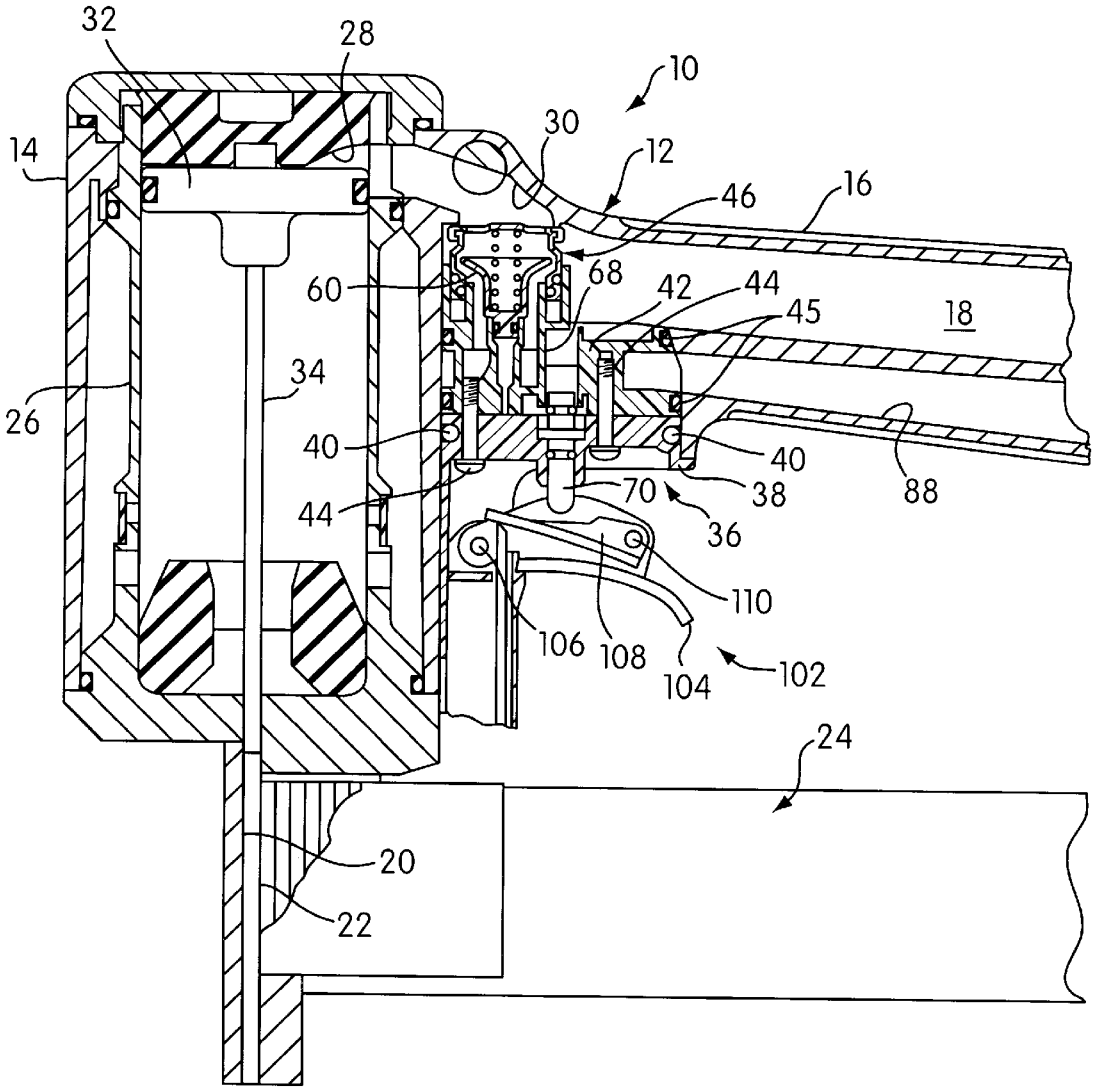
FIG. 1 is view of a fastener driving device, shown partially in section, including a standard control module provided in accordance with the principles of the present invention.

Referring now more particularly to the drawings, FIGS. 1–8 show a pneumatically operated fastener driving device, generally indicated at 10, which embodies the principles of the present invention when used with a standard control module assembly.

The device 10 includes a housing, generally indicated at 12, which includes a generally cylindrical or tubular housing portion 14 and a main frame portion 16 extending laterally from the cylindrical housing portion 14. The main frame portion defines a hand grip portion of hollow configuration which constitutes a reservoir chamber 18 for containing air under pressure coming from a source which is communicated therewith. The cylindrical portion 14 of the housing 12 includes the usual nose piece defining a fastener drive track 20 which is adapted to receive laterally therein the leading fastener 22 from a package of fasteners mounted within a fastener magazine assembly, generally indicated at 24, of conventional construction and operation. Mounted within the cylindrical portion of housing 12 is a cylinder 26 which has its upper end 28 disposed in communicating relation exteriorly with the reservoir chamber 18 via a passageway 30. Mounted within the cylinder 26 is a drive piston 32. The cylinder 26 mounts conventional check valves indicated at 27. Carried by the piston 32 is a fastener driving element 34 which is slidably mounted within the drive track 20 and movable by the piston 32 through a cycle of operation which includes a drive stroke during which the fastener driving element 34 engages a fastener within the drive track 20 and moves the same longitudinally outwardly into a workpiece, and a return stroke.

In order to effect the aforesaid cycle of operation, there is provided a control module, generally indicated at 36, constructed in accordance with the present invention. The control module 36 includes a control module housing assembly, which, in the illustrated embodiment includes a trigger housing 38 coupled to the main frame portion 16 by pin connections at 40, and a valve housing 42 secured to the trigger housing 38 by fasteners, preferably in the form of screws 44. Housings 38 and 42 are preferably molded from plastic material. O-rings 45 seal the valve housing 42 within the main frame portion of the housing 12. It can be appreciated that the control module housing assembly can be formed as a single unit.

The control module 36 includes a main valve 46 mounted with respect to the valve housing 42. With reference to FIG. 2, the main valve 46 is cylindrical having an outer peripheral surface 48 and an inner peripheral surface 50. The main valve 46 is mounted with respect to the passageway 30 to be moveable between opened and closed positions to open and close the passageway 30. The main valve 46 includes a first annular pressure area 52 and a second, opposing annular pressure area (A–E in the FIGS. 1–7). As shown in FIG. 2, when the device 10 is at rest with the main valve 46 in its closed position, pressure area A extends beyond annular housing seating surface 56 and is exposed to reservoir pressure. Spring structure, in the form of a coil spring 58 biases the main valve 46 to its closed position, together with reservoir pressure acting on pressure area 52. Thus, the force of the spring 58 plus the force acting on pressure area 52 is greater than the force due to pressure acting on the opposing pressure area A, which results in the keeping the main valve 46 in its closed position. The spring 58 is disposed between a surface of an exhaust seal structure, generally indicated at 60, and a surface of the main valve 46.

The first pressure area 52 together with annular groove portion 62 of the valve housing 40 define a pressure chamber 64. The pressure chamber 64 is in communication with the reservoir pressure or high pressure in chamber 18 via passageways 66 and 67 (FIG. 8) which communicate with the bore 68. Bore 68 houses an actuating member 70 and is exposed to reservoir pressure in chamber 18 via port 69. This high pressure in chamber 64 is dumped to atmosphere to open the main valve 46, as will be explained below.

A urethane seal member 72 is attached to the edge of the upper surface 73 of the main valve 46 enhancing sealing between the main valve and the housing seating surface 56 when the main valve 46 is in its closed position. In the illustrated embodiment, the upper surface 73 of the main valve 46 includes a plurality of ports 74 therein so that the passageway 30 and thus the upper end 28 of the cylinder may communicate with an exhaust passage 76, defined in the control module housing assembly, the function of which will become apparent below. O-ring seals 78 and 80 are provided for sealing the main valve 46 within the valve housing 42.

The exhaust seal structure 60 is fixed to the valve housing 42 such that surface 82 of the seal structure 60 engages surface 84 of the valve housing 42. The seal structure 60 is disposed within an interior of the main valve 46 and includes an annular valve element 86 which engages the inner peripheral surface 50 of the main valve 46 when the main valve is in its fully opened position (FIG. 4), which closes the exhaust passage 76 and prevents the upper end 28 of the cylinder from communicating with an exhaust path 88, as will be explained more fully below.

Figure 8:
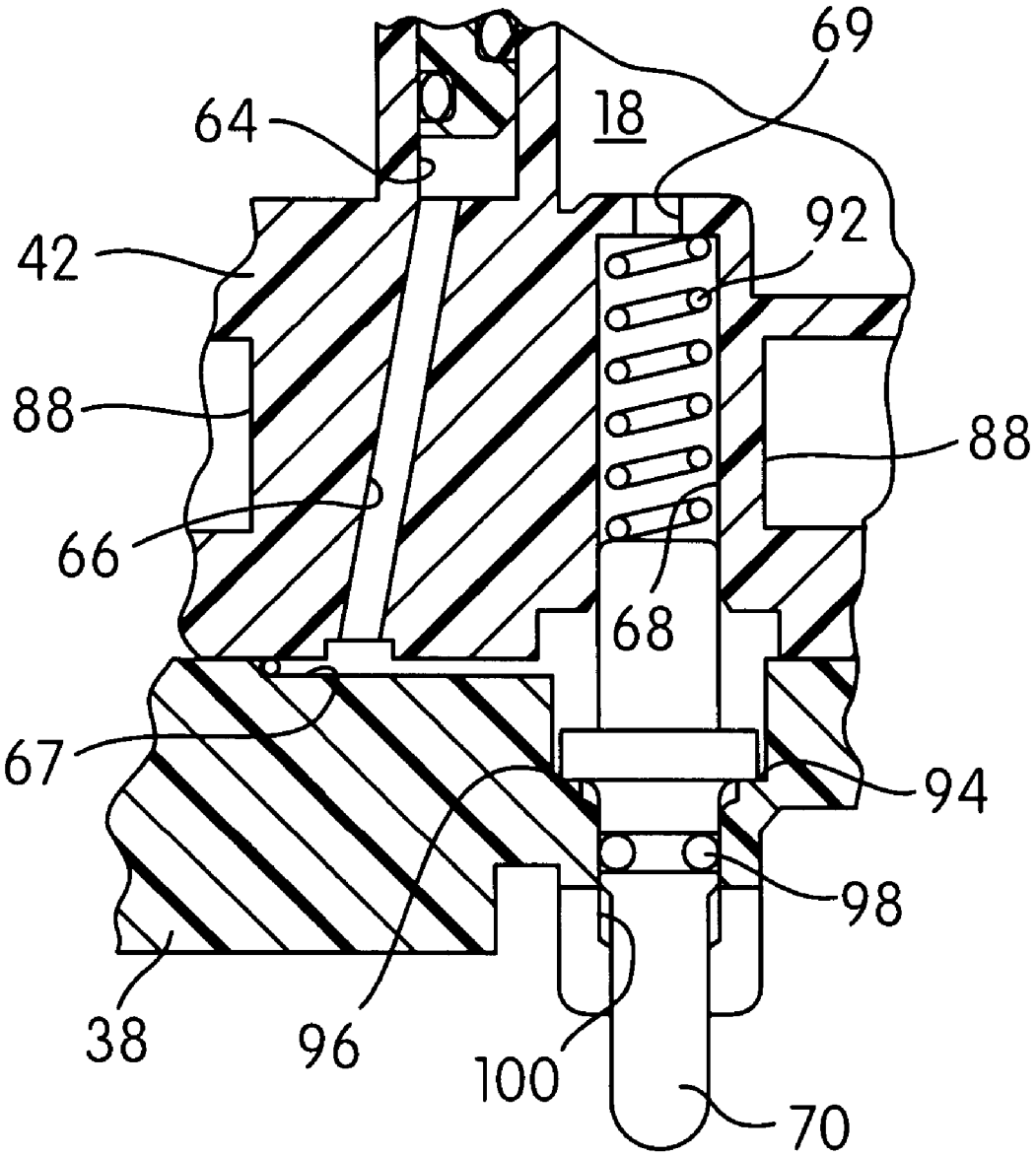
FIG. 8 is an enlarged, sectional view showing the communication passages between a pressure chamber and the actuating member.

The control module 36 includes the actuating member 70 which is carried by the module 36 for rectilinear movement from a normal, sealed position into an operative, unsealed position for initiating movement of the main valve 46 to its open position, thereby initiating movement of the fastener driving element 34 through a fastener drive stroke. The actuating member 70 is normally biased to its normal, sealed position by a coil spring 92 and reservoir pressure via port 69. As shown in FIG. 8, in the sealed position, surface 94 of actuating member 70 engages housing surface 96 and O-ring 98 is compressed, sealing an exhaust port 100.

Figure 2:
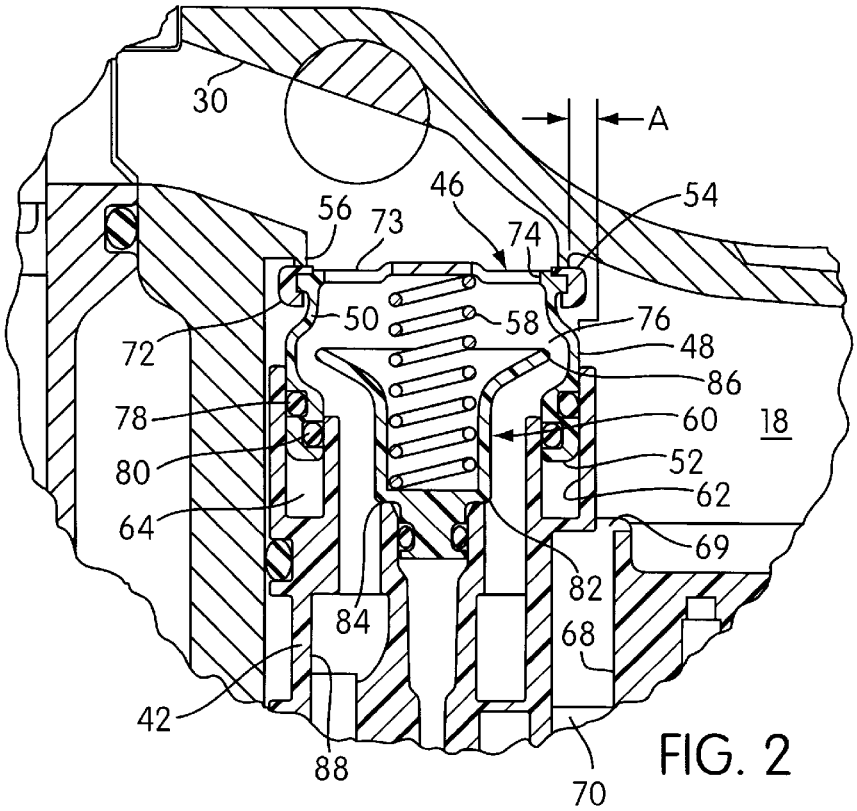
FIG. 2 is an enlarged, sectional view of a main valve of the control module shown in a closed position when the device is at rest.
Figure 3:
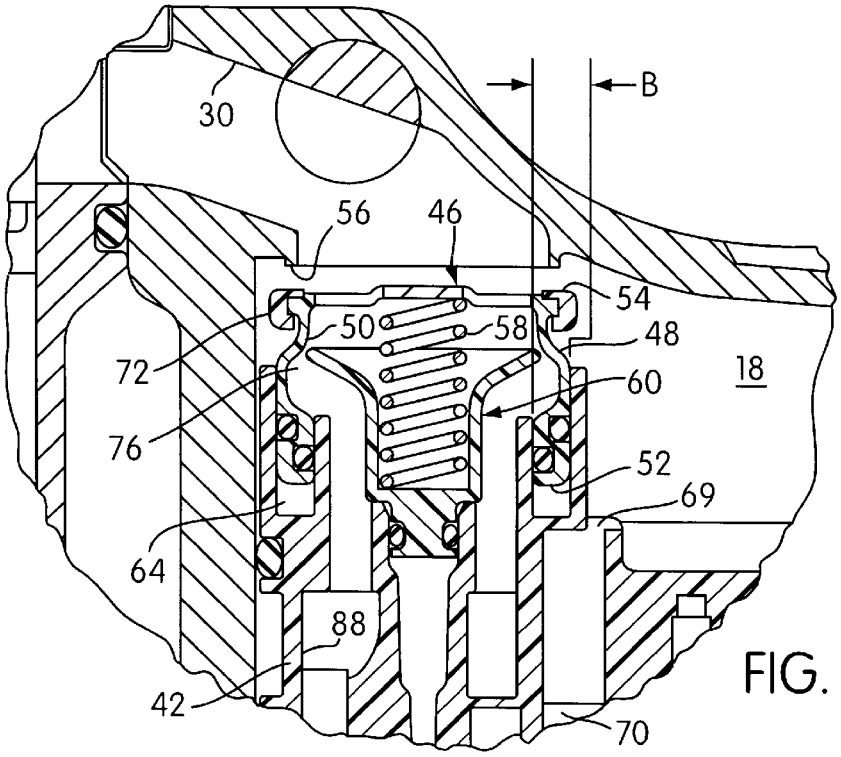
FIG. 3 is a view similar to FIG. 2, showing the main valve in an initial opening position.

As shown in FIG. 1, the control module 36 includes a manually operated trigger assembly, generally indicated at 102, for moving the actuating member 70. The trigger assembly includes a trigger 104 pivoted to the trigger housing 38 at pin 106 and a rocker arm 108 pivoted to the trigger 104 at pin 110. Thus, movement of the trigger 104 causes the rocker arm 108 to engage and move the actuating member 70 from its sealed position to its operative, unsealed position.

The operation of the device 10 will be appreciated with reference to the Figures. As shown in FIG. 2, when the device 10 is at rest, spring 58 together with reservoir pressure in chamber 64 acting on pressure area 52 biases the main valve 46 to its closed position. Thus, the force created by reservoir pressure acting on pressure area 52 plus the force of the spring 58 is greater than the force created by the reservoir pressure acting on pressure area A, maintaining the main valve 46 in its closed position. Over-the-piston pressure in passageway 30 is atmospheric pressure since the exhaust passage 76 is in communication with the exhaust path 88. Exhaust path 88 communicates with atmosphere at the rear of the device 10.

To initiate a fastener drive stroke, the trigger 104 is pulled which causes the rocker arm 108 to contact the actuating member 70 moving it to its operative, unsealed position thus opening port 100. This action releases high pressure air in pressure chamber 64, under the main valve 46, via passageways 66 and 67 and exhaust port 100. Initially, since pressure area 52 of the main valve 46 is exposed to low pressure air, high pressure air acting on pressure area A overcomes the bias of spring 58 plus the low pressure air acting on area 52 and initiates movement of the main valve 46 off seating surface 56. Thereafter, the force created by reservoir pressure acting on pressure area B (FIG. 3) is again greater than the force of the spring 58 plus the force created by the atmospheric pressure acting at pressure area 52. This accelerates movement of the main valve 46 towards its opened position. As a result, the low pressure air in passageway 30 becomes high pressure air via the reservoir chamber 18 and the high pressure air forces the main valve 46 open, thus permitting the high pressure air to communicate with the one end 28 of the cylinder 26 to move the piston 32 in the direction to effect the drive stroke of the fastener driving device 10.

Figure 4:
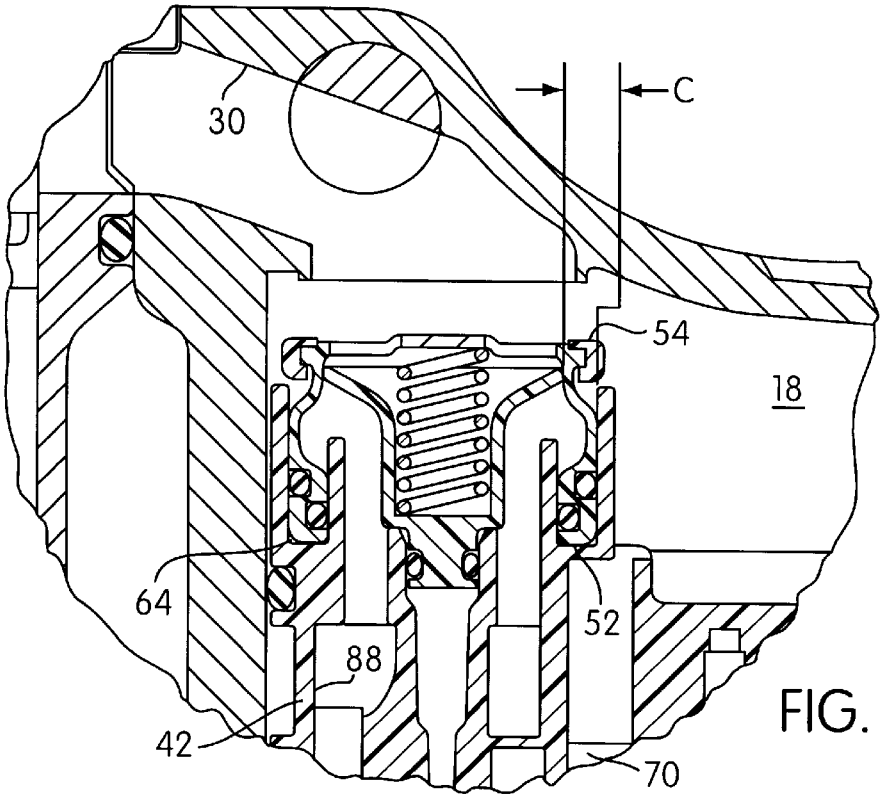
FIG. 4 is a view similar to FIG. 2, showing the main valve in its fully opened position initiating a fastener drive stroke.

As shown in FIG. 4, when the main valve 46 is opened fully, the force created by reservoir pressure acting on pressure area C is greater than the force of the spring 58 at its compressed height plus the force created by the atmospheric pressure acting on pressure area 52. In this position, the main valve 46 engages valve element 86 which closes passage 76 preventing the reservoir pressure at the upper end 28 of the cylinder from exiting the device 10 through the exhaust path 88.

Figure 5:
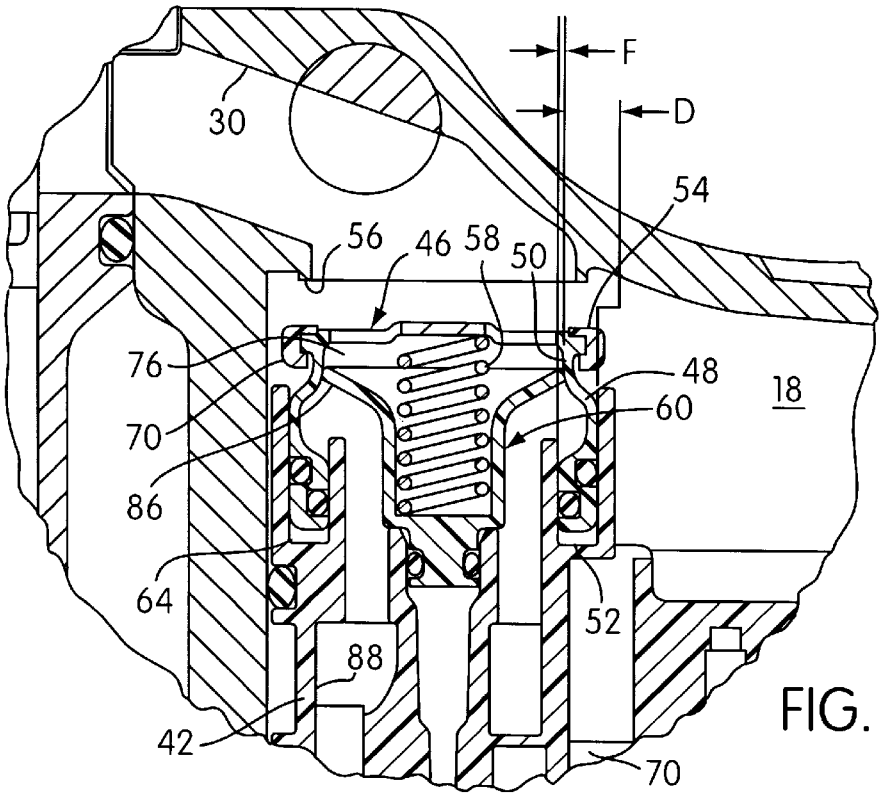
FIG. 5 is a view similar to FIG. 2, showing the main valve being initially moved to the closed position by pneumatic and spring bias.

FIG. 5 shows the initial shift of the main valve 46 to its closed position during the return stroke of the piston. Thus, when the trigger 104 is released, the actuating member 70 moves to its sealed position and reservoir pressure fills the pressure chamber 64 via port 69. At this position, the force created by reservoir pressure acting on pressure area 52 plus the force of the spring 58 is greater than the force created by the reservoir pressure at pressure area D. This causes the main valve 46 to begin to move upwardly towards its closed position. Surface area offset F creates a pneumatic bias which assists the spring 58 to overcome the friction between the main valve 46 and the exhaust seal structure 60.

As shown in FIG. 8, port 69 is a feed orifice which is sized to control the piston dwell at the bottom of its stroke. The area of exhaust path 100 is greater than the area of port 69, thus, high pressure in cavity 64 will decay once the O-ring 98 of the actuating member 70 is unsealed. As another preferred arrangement, especially for high-speed skid fire/rapid fire applications, the actuating member is provided with two O-rings, a lower and an upper O-ring, with the lower O-ring being positioned in similar location to O-ring 98 shown in FIG. 8, but is upwardly spring biased by a compression spring disposed in exhaust path 100. It also has an upper O-ring disposed in the bore which seals off feed port orifice 69, which orifice 69 is sealed before exhaust path 100 is unsealed. This arrangement is disclosed in greater detail in co-pending patent application Ser. No. 60/033,243, hereby incorporated by reference.

Figure 6:
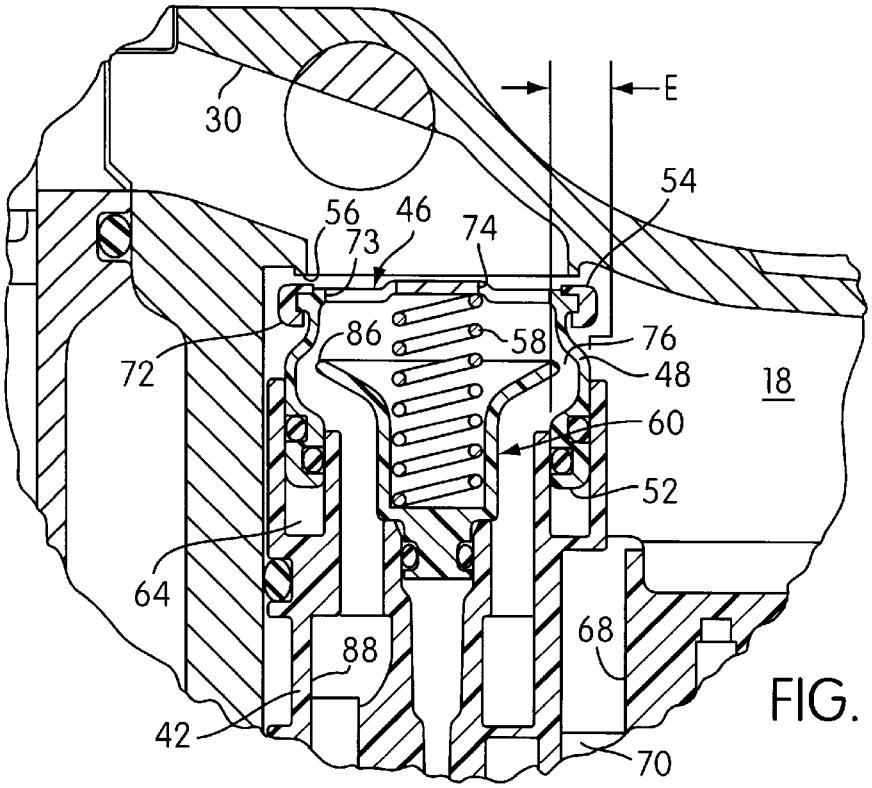
FIG. 6 is a view similar to FIG. 2, showing the main valve being moved by spring bias only to the closed position during the return stroke of device.

FIG. 6 shows the main valve 46 moving to its closed position. At this position, the force created by reservoir pressure acting on pressure area 52 plus the force of the spring 58 is greater than the force created by the reservoir pressure on pressure area E. Pressure area E is generally equal to pressure area 52. Since exhaust passage 76 is now opened, the upper end 28 of the cylinder (FIG. 1) is exposed to atmospheric pressure.

Figure 7:
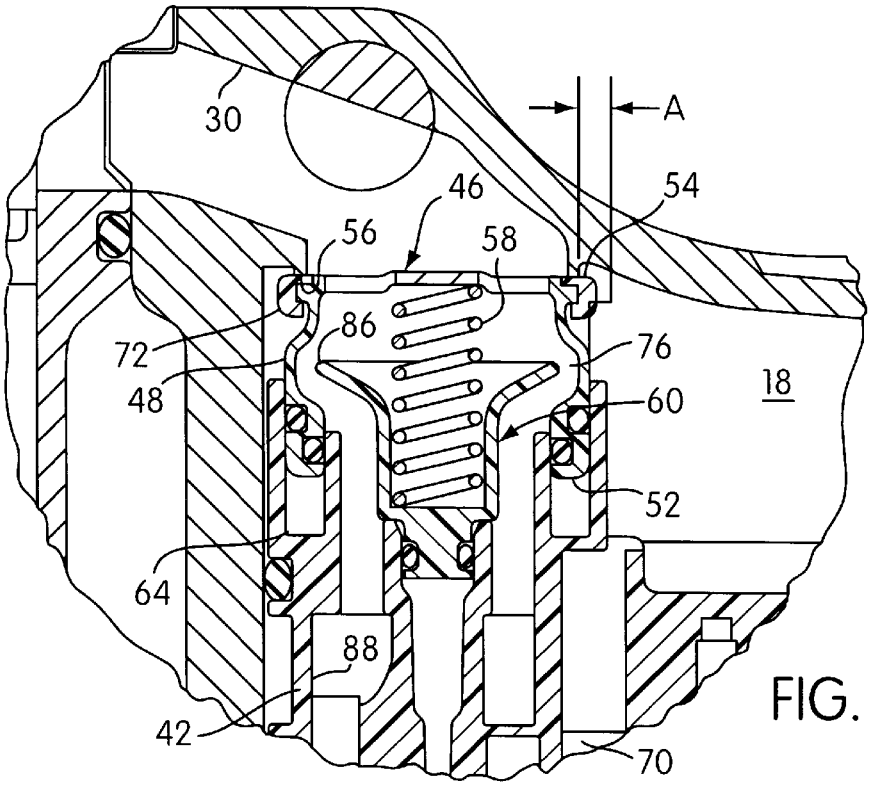
FIG. 7 is a view similar to FIG. 2, showing the main valve returned to its closed position.

FIG. 7 shown the main valve returned to its closed position, completing an operating cycle of the device 10.

The single O-ring of the actuating member 70 enhances the main valve 46 response. When the device 10 is at rest, the actuating member force equals the spring 92 force plus the pneumatic force acting on member 70 via port 69. When the actuating member 70 is moved to its unsealed position, the actuating member force equals the spring force only. This creates a poppet-like condition which tends to accelerate the actuating member 70 when the pneumatic force decays.

It can be appreciated that by positioning the main valve 46 in the frame of the device 10, the overall tool height is reduced. Further, since the valve assembly is contained within a single unit in the form of the control module 36, the device is easy to assembly and service.

Figure 9:
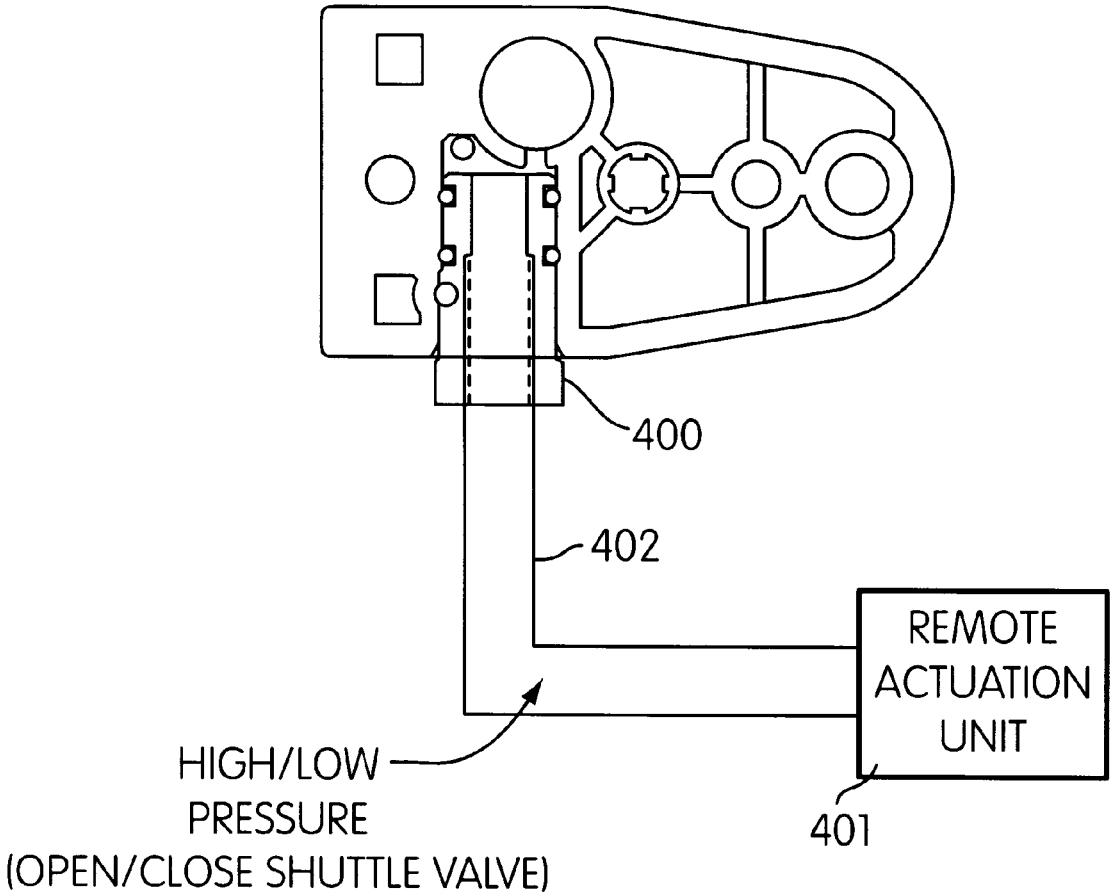
FIG. 9 is a schematic view showing a remote actuation unit operable to actuate the shuttle valve by an auxiliary pressure source.
Figure 10:
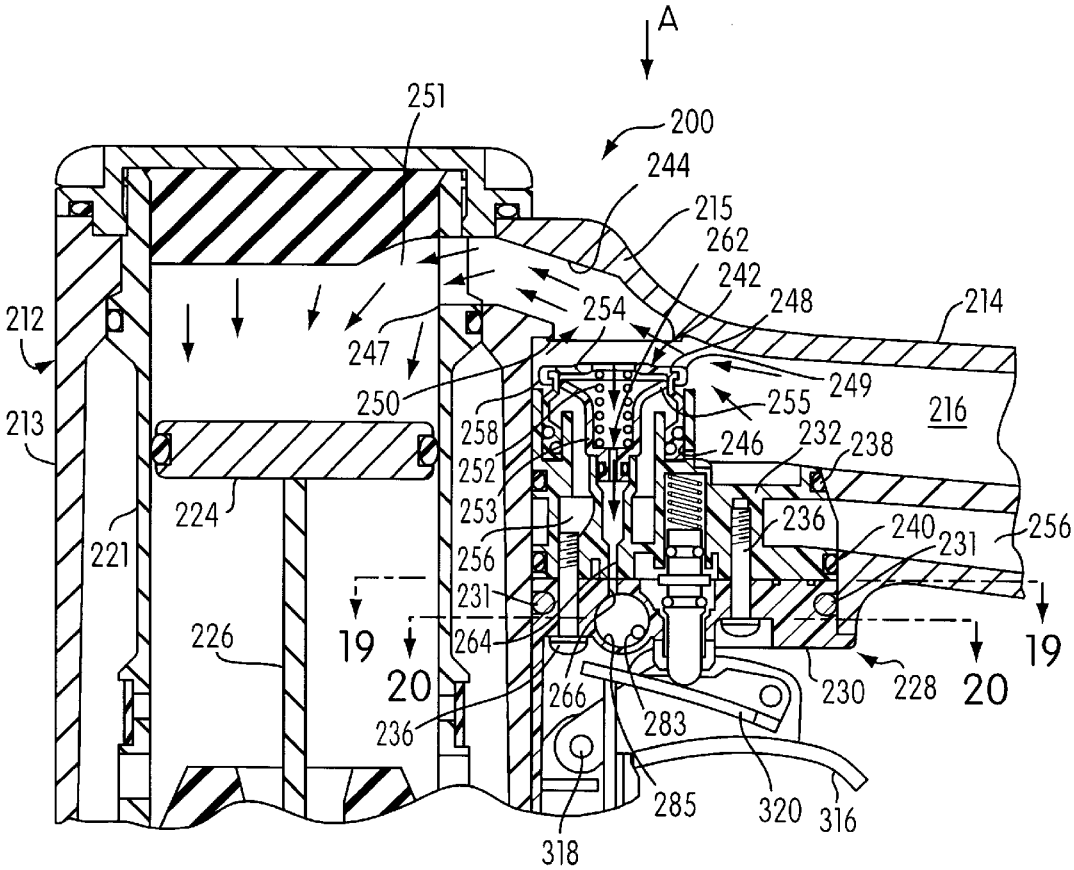
FIG. 10 is a sectional view of a fastener driving device including an automatic control valve module provided in accordance with the principles of the invention.

In FIGS. 9–20, the present invention is shown while operative with an automatic control module in accordance with the invention. A pneumatically operated fastener driving device, generally indicated at 200, is shown in FIG. 10. The device 200 includes a housing, generally indicated at 212, having a cylindrical housing portion 213 and a frame housing portion 215, extending laterally from the cylindrical housing portion 213. A hand grip portion 214 of hollow configuration is defined in the frame housing portion 215, which constitutes a reservoir chamber 216 for air under pressure coming from a source which is communicated therewith. The housing 212 further includes the usual nose piece defining a fastener drive track (not shown) which is adapted to receive laterally therein the leading fastener from a package of fasteners mounted within a magazine assembly (not shown) of conventional construction and operation. Mounted within the cylindrical housing portion 213 is a cylinder 221 which has its upper end disposed in communicating relation with the reservoir chamber 216 via passage. Mounted within the cylinder 221 is a piston 224. Carried by the piston 224 is a fastener driving element 226 which is slidably mounted within the drive track and movable by the piston and cylinder unit through a cycle of operation which includes a drive stroke during which the fastener driving element 226 engages a fastener within the drive track and moves the same longitudinally outwardly into a workpiece, and a return stroke.

In order to effect the aforesaid cycle of operation, there is provided a control module (also referred to herein as a "control valve assembly"), generally indicated at 228, constructed in accordance with the present invention. The control module or control valve assembly 228 includes a housing unit, which, in the illustrated embodiment includes a trigger housing 230 removably coupled to the frame portion 215 by pin connections at 231, and a valve housing 232 secured to the trigger housing 230 by fasteners, preferably in the form of screws 236. Housings 230 and 232 are preferably molded from plastic material. O-rings 238 and 240 seal the valve housing 232 within the frame portion of the housing 212.

Referring now more particularly to FIG. 10, the control module 228 includes a main valve 242 mounted with respect to the valve housing 232 and associated with the passageway 244 between one end 247 of the cylinder 221, defining piston chamber 251, and the reservoir chamber 216. The main valve 242 is moveable between opened and closed positions to open and close the passageway 244 and has a first annular pressure responsive surface 246 and a second, opposing annular pressure responsive surface 248. When the main valve is closed, a portion 249 of surface 248 extends beyond annular housing seat 250 and is exposed to reservoir pressure in the reservoir 216. Spring structure, in the form of a coil spring 252 biases the main valve 242 to its closed position, together with reservoir pressure acting on surface 246. Thus, the force of the spring 252 plus the force acting on surface 246 is greater than the force due to pressure acting on the portion 249 of the opposing surface 248, which results in the keeping the main valve 242 in its closed position. The spring 252 is disposed between a surface of an exhaust seal 253 and a surface of the main valve 34. The exhaust seal 253 is fixed to the valve housing 232 and an upper annular surface 255 thereof contacts an inner surface of the main valve 242 when the main valve is in its fully opened position thereby closing an exhaust path 254. Exhaust path 254 communicates with the atmosphere via exhaust 256.

A urethane seal member 258 is attached to the main valve 242 at surface 248 and ensures sealing when the main valve is closed. When the main valve 242 is in its closed position, surface 248 of the main valve is in sealing engagement with seat 250 of the housing 212. O-ring seals 260 are provided for sealing the main valve 242 within the valve housing 232.

An axial passage structure, generally indicated at 262, is defined through the main valve 242 and exhaust seal 253. The passage structure 262 includes passage 264 of the valve housing 232 and passage 266 of the trigger housing 230. The passage structure 262 provides a pressure signal to secondary valve structure, as will become apparent below.

A pressure chamber 268 (FIG. 11) is defined between the first pressure responsive surface 246 of the main valve 242, and a portion of the valve housing 232. The pressure chamber 268 is in communication with the reservoir or high pressure in chamber 216 via a feed orifice 270. This high pressure in chamber 268 is dumped to atmosphere to open the main valve 242, as will be explained below.

Figure 11:
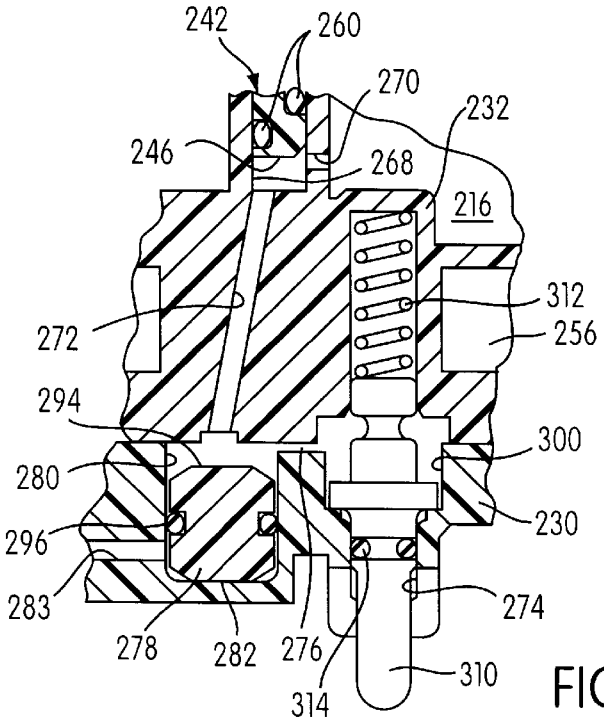
FIG. 11 is a partial sectional view of the valve module shown in FIG. 10, and showing the relative positions of the main valve and secondary valve member when the device is at rest.

With reference to FIG. 11, a passage 272 connects the pressure chamber 268 and an exhaust port 274 via a restrictive bleed path 276. Passage 272, bore 280, bleed path 276 define first passage structure between the pressure chamber 268 and the exhaust port 274, the function of which will be apparent below.

The control module 228 includes a secondary valve member in the form of a shuttle valve 278 mounted in bore 280 of trigger housing 230 (FIG. 11). The shuttle valve 278 is generally cylindrical and has a first effective pressure surface 282 which is in pressure communication with over-the-piston pressure which is the pressure communicating with the piston chamber 251. This pressure may be low or high pressure, depending on what part of the cycle the device is operating. Such communication is achieved since surface 282 communicates with port 283, which in turn communicates with needle valve bore 285, which is in communication with the axial passage structure 262, via passage 264 of valve housing 232 and passage 266 of trigger housing 230. The axial passage structure 262 is opened to passage 244 and thus open to the piston chamber 251. These passages define second passage structure providing direct communication between the shuttle valve and the piston chamber 251.

A needle valve assembly, generally indicated at 284 (FIG. 20) is housed in bore 285. The needle valve assembly 284 includes a manually adjustable needle valve 286. A pressure path 288 communicates with the needle valve 286, the port 283 and passage 266. When the valve housing 232 is coupled to the trigger housing 230, a pressure cavity 292 is defined and port 290 communicates the pressure cavity 292 (FIG. 19) with the port 283. The restriction defined by the needle valve 286 selectively controls the piston dwell at the top of its stroke. Further, pressure cavity 292 reduces the sensitivity of the needle valve 286. An O-ring seal member 300 provides a seal between the trigger housing 230 and the valve housing 232.

The shuttle valve 278 has a second pressure surface 294 opposing the first pressure surface 282 and in communication with the reservoir chamber 268 via port 272. Surfaces 294 and 282 have equal areas. As shown in FIG. 11, when the shuttle valve 278 is in its opened position normally biased by reservoir pressure at surface 278, communicated from port 272 and bore 280 via feed orifice 270, passage 272 communicates with the restrictive bleed path 276. O-ring 296 prevents the reservoir or high pressure air from passing the shuttle valve 278. Surface 282 is exposed to atmospheric pressure since over-the-piston pressure in port 283 is atmospheric pressure at exhaust 256.

Figure 12:
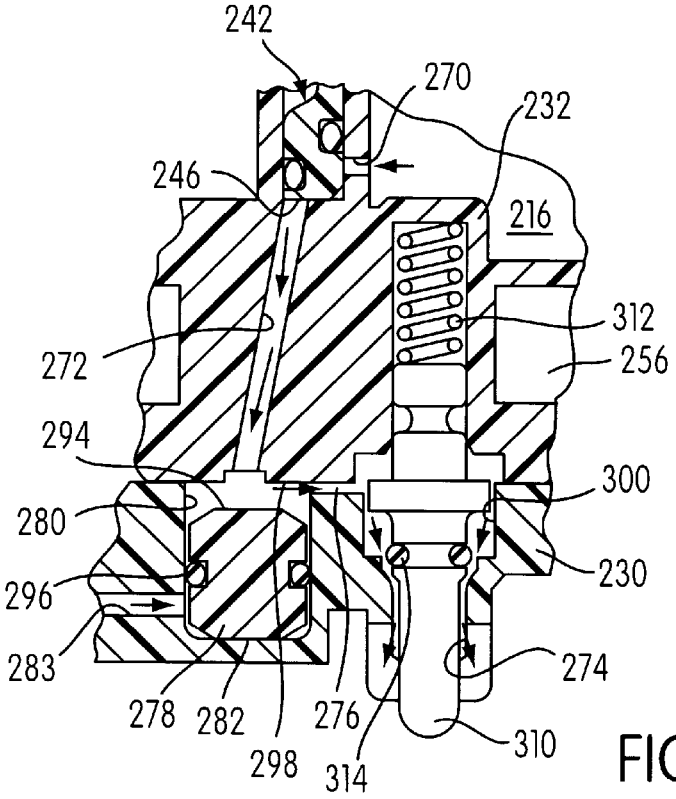
FIG. 12 is a sectional view similar to FIG. 11, showing an actuating member actuated moving the main valve to an opened position.

With reference to FIG. 12, when over-the-piston pressure or high pressure acts on surface 282 imposing a greater force than a force acting on surface 294 due to reservoir pressure communicating therewith, the shuttle valve 278 is moved towards its closed position wherein surface 294 of the valve 278 engages surface 298 of the valve housing 232 so as to prevent communication between port 272 and the exhaust port 274. O-ring 296 prevents pressure in port 283 from communicating with passage 272 and path 276.

As shown in FIG. 11, the restrictive bleed path 276 connects the passage 272 and bore 280 with a trigger stem bore 300. The trigger stem bore 300 communicates with the exhaust port 274. A trigger stem 310, defining an actuator, is carried by the trigger housing 230 for movement from a normal, sealed position into an operative, unsealed position for initiating movement of the main valve 242 to its opened position, thereby initiating movement of the fastener driving element 226 through a fastener drive stroke. The actuator 310 is normally biased to its normal, sealed position by a coil spring 312. As shown in FIG. 11, in the sealed position, the actuator 310 engages a surface of the trigger housing 230 with an O-ring 314 compressed therebetween, sealing the exhaust port 274.

With reference to FIG. 10, the control module 228 includes a trigger assembly including a trigger member 316 pivoted to the trigger housing 230 at pin 318 for manual movement from a normal, inoperative position into an operative position. The trigger assembly also includes a rocker arm 320 which is pivoted to the trigger member 316 via a pin. Upward movement of the trigger member 316 causes the rocker arm 320 to engage and move the actuator 310 from its sealed position to its operative, unsealed position.

The operation of the control module 228 will be appreciated with reference to FIGS. 10–20. As shown in FIG. 11, when the device 200 is at rest, reservoir pressure from feed orifice 270 acting on surface 246 biases the main valve 242 against seat 250 of the housing preventing reservoir pressure to enter the open end 246 of the cylinder 221. The main valve 242 is biased upwardly since surface area 246 is greater than the surface area of portion 249 extending beyond seat 250. Reservoir pressure enters the passage 272 and bore 280 and biases the shuttle valve 278 to its opened position due to pressure being exerted on surface 294 of the shuttle valve. Over-the-piston pressure in port 283 is low pressure since the upper end 246 of the cylinder 221 is exposed to atmospheric pressure via the axial passage 262 and exhaust 256. The actuating member 310 is in its normal, sealed position with exhaust port 274 enclosed.

Figure 13:
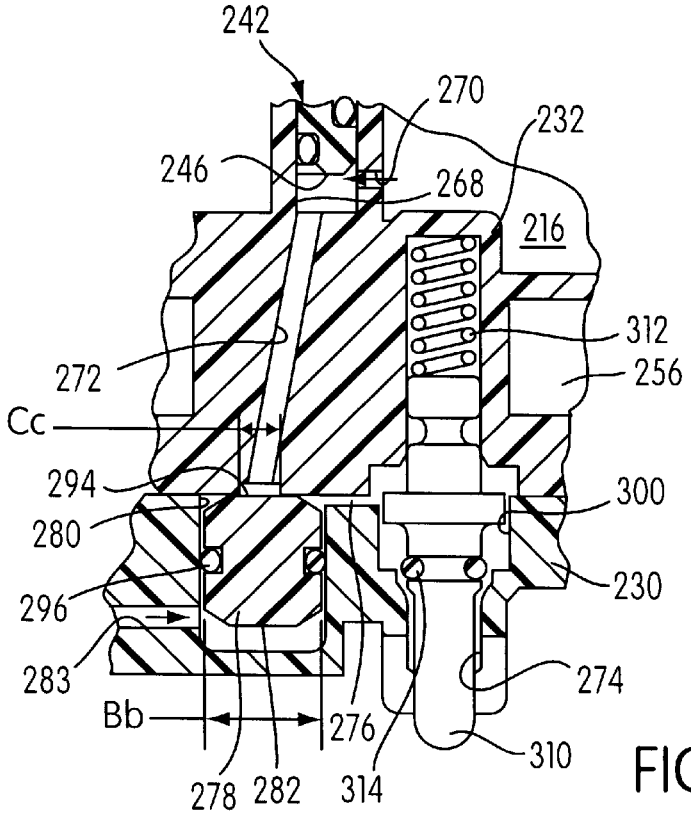
FIG. 13 is a view similar to FIG. 12, showing the main valve and secondary valve member in closed positions during a return stroke of the piston.

As shown in FIG. 12, when the actuator 310 is moved upwardly by manual movement of the trigger 316, exhaust port 274 is opened which dumps the pressure in the pilot pressure chamber 268 to atmosphere via the passage 272, bore 280 and bleed path 276. This causes the main valve to shift to its opened position as shown in FIG. 10, permitting reservoir pressure to pass through passageway 244 and into the piston chamber 251 to cause the fastener driving element to move through a drive stroke. At this time, over-the-piston pressure begins to go to high pressure since reservoir pressure passes through the axial passageway 262 into port 285 and into port 283. As shown in FIG. 13, with the actuator 310 still actuated, during the return stroke of the fastener driving element, the over-the-piston pressure or high pressure in passage 283 shifts the shuttle valve 278 to its closed position preventing communication between passage 272 and the exhaust port 274.

As shown in FIG. 12, when the main valve 242 is opened fully, the force created by reservoir pressure acting on pressure surface 248 is greater than the force of the spring 252 at its compressed height plus the force created by the atmospheric pressure acting on pressure surface 246. In this position, the main valve 242 engages valve element 255 which closes passageway 254 preventing reservoir pressure at the upper end 246 of the cylinder from exiting the device 200 through the exhaust 256.

Over-the-piston pressure air or high pressure air bleeds through the axial passage 262 through pressure path 288 and needle valve bore 285 under the shuttle valve 278 and into port 290 and thus into cavity 292. Cavity 292 is similar to cavity 140, discussed above, and provides a volume which aids in reducing the needle valve adjustment sensitivity. Over-the-piston pressure air builds in cavity 292 communicating with surface 282 of the shuttle valve 278, thus, shifting the shuttle valve 278 to its closed position, as shown in FIG. 13. This occurs since force created by over-the-piston pressure acting in surface area Bb is greater than reservoir pressure acting in surface area Cc. The shuttle valve 278 prevents passage 272 from communication with exhaust port 274. Thus, chamber 268 is filled with reservoir pressure via feed orifice 270. The feed orifice controls the piston dwell at the bottom of its stroke. High pressure air then shifts the main valve 242 to its closed position such that seal 258 is engaged with seat 250 of the housing. Over-the-piston pressure exhausts through the axial passage structure 262 and through the exhaust 256. Over-the-piston pressure in cavity 292 bleeds through port 290 (FIG. 19) past the needle valve 286, and then bleeds through the pressure path 288, through passage 266 and housing passage 264 of the axial passage structure 262 and finally out through the exhaust 256. High pressure under the shuttle valve 278 acting on surface 282 bleeds to atmosphere, thus reservoir pressure on surface 294 shifts the shuttle valve 278 to its opened position. The reservoir pressure under the main valve 242 in chamber 268 is then released through passage 272, through bore 280 and the restrictive path 276 and through the exhaust port 274 to atmosphere. High pressure in reservoir 216 forces the main valve 242 to its opened position in the manner discussed above, thus, driving the piston downwardly. The working cycle of the piston is repeated as long as the actuator 310 is held in its unsealed, actuated position. Release of the trigger member 316 returns the device to its rest position. The shuttle valve 278 begins to open when a force created by over-the-piston pressure acting on surface area Bb equals a force created by reservoir pressure acting on surface area Cc. Surface area Cc is significantly less than surface area Bb. It has been determined that the greater the ratio between surface area Bb and surface area Cc, more bleed down occurs and thus, a better signal is produced. This makes the device more responsive.

Figure 14:
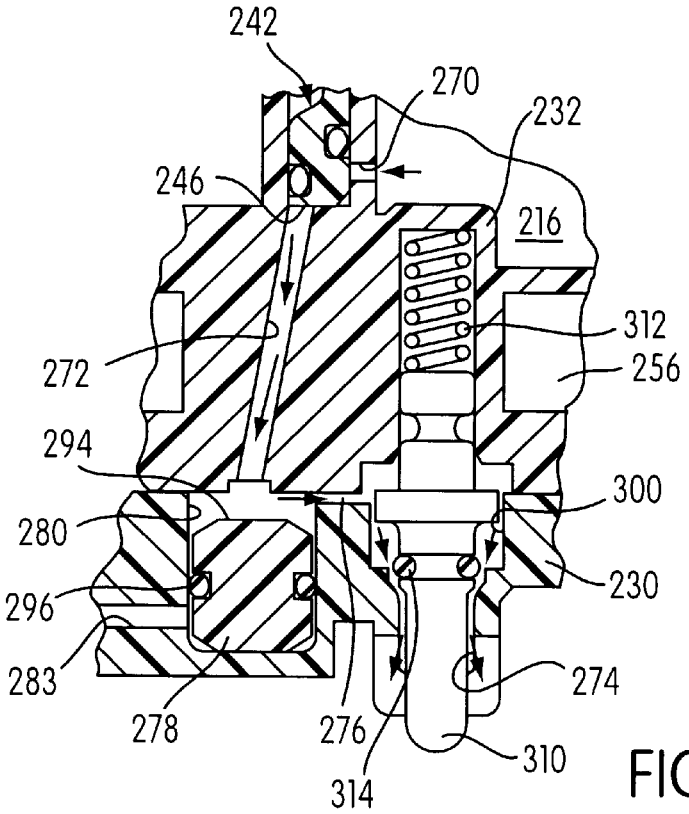
FIG. 14 is a view similar to FIG. 12, showing the main valve and the secondary valve member in opened positions during the drive stroke of the piston.

FIG. 14 shows the shuttle valve in its opened position biased by reservoir pressure acting on surface 294 with port 283 exposed to over-the-piston pressure which is atmospheric pressure.

Figure 15:
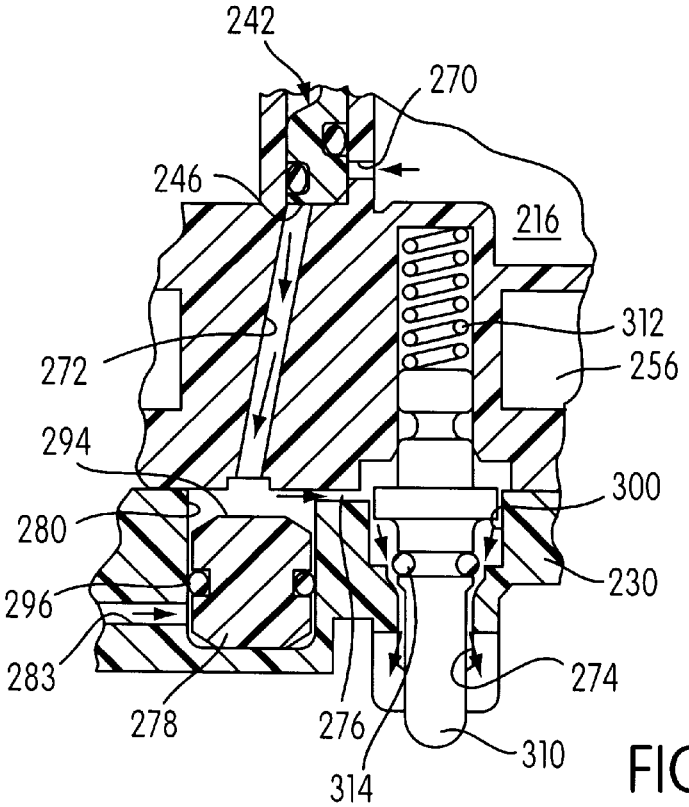
FIG. 15 is a view similar to FIG. 14, showing over-the-piston pressure acting on the secondary valve member going to high pressure.
Figure 16:
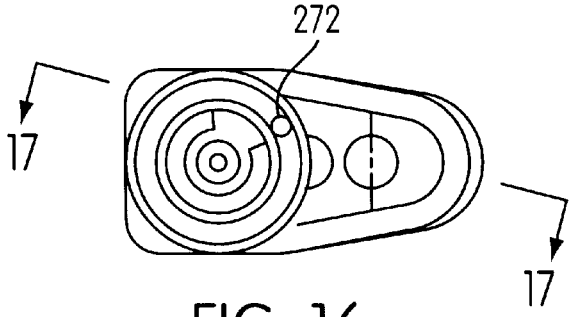
FIG. 16 is a view of a valve housing as seen in the direction of arrow A of FIG. 10, shown with the main valve removed for clarity of illustration.

FIG. 15 shows over-the-piston pressure in port 283 beginning to go to high pressure to repeat the working cycle of the device 200.

Figure 17:
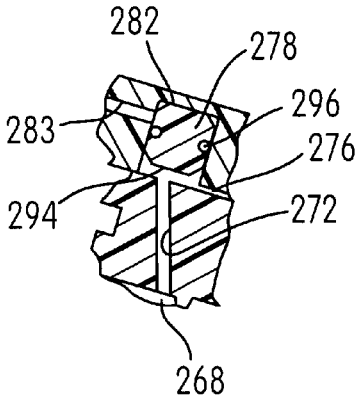
FIG. 17 is a partial sectional view taken along the line 17—17 of FIG. 16, showing the secondary valve member in an opened position.
Figure 18:
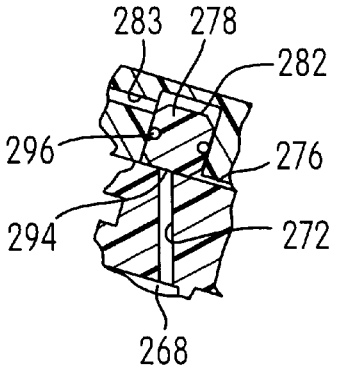
FIG. 18 is a partial sectional view taken along the line 17—17 in FIG. 16, showing the secondary valve member in a closed position.
Figure 19:
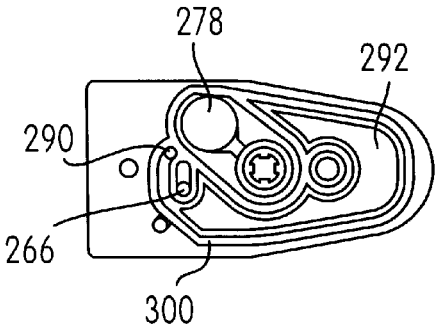
FIG. 19 is a view of the trigger housing of the control valve module taken along the line 19—19 of FIG. 10.
Figure 20:
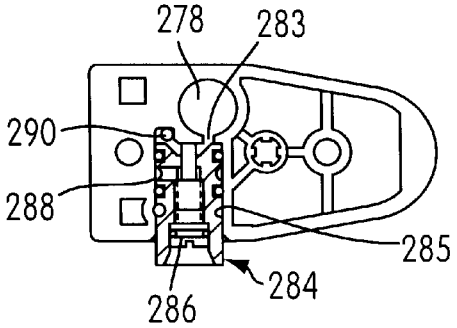
FIG. 20 is a view taken along the line 20—20 of FIG. 10.

With reference to FIGS. 17 and 18, the function of the restrictive path 276 will be appreciated. When passage 272 is open, restricted exhaust air in the restricted path 276 creates high pressure over the shuttle valve 278 on surface 294. The shuttle valve is thus shifted to its opened position by high pressure acting on surface 294. Path 276 creates pressure over the shuttle valve and a bleed down delay to ensure full shuttle valve stroke.

It can be appreciated that by positioning the main valve 242 in the frame of the device 200, the overall tool height is reduced. Further, since the control module 228 is in the form of a single unit, removable from the housing 212, the device is easy to assembly and service.

As shown in FIG. 9, a remote actuation unit 401 permits the pneumatic fastener driving device, such as the automatic device shown in FIG. 10, to be operated remotely, without the need for manual actuation of a trigger. The remote actuation unit 401 permits the pneumatic fastener driving device to be mounted on a machine, for example, in an assembly line and operated remotely.

Figure 31:
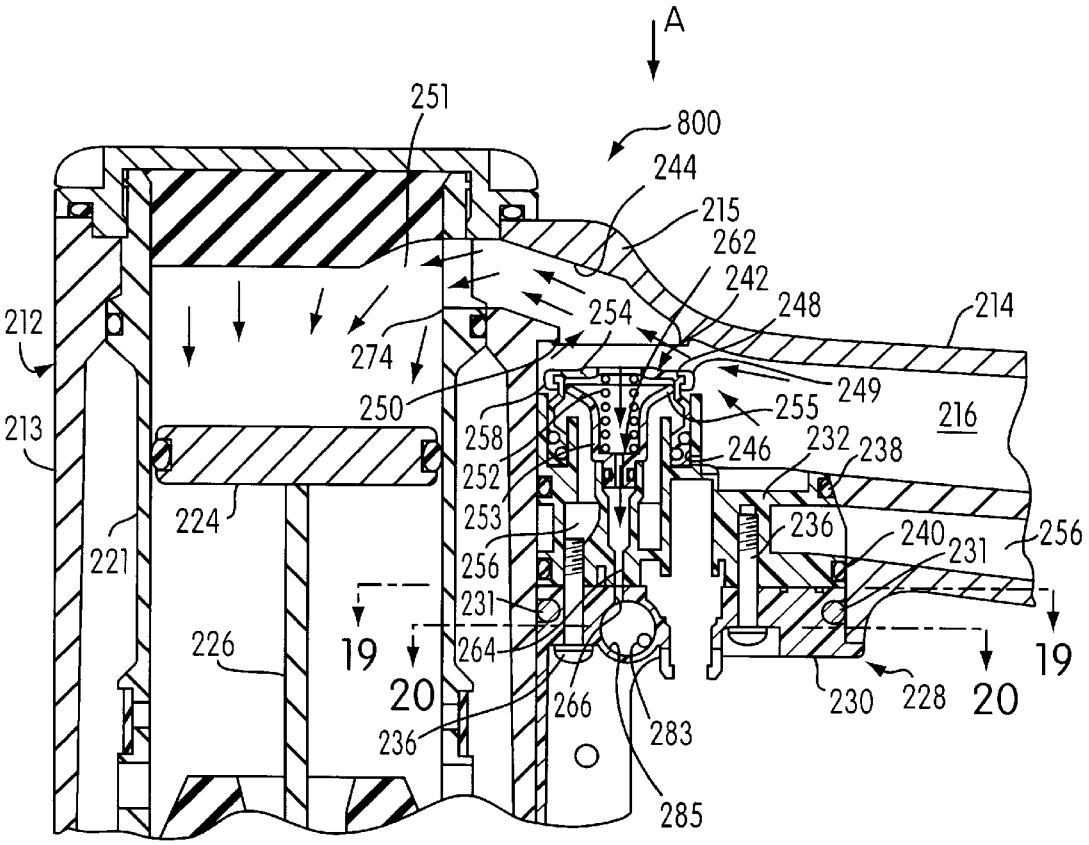
FIG. 31 is a partial cross sectional view of a preferred embodiment of an automatic pneumatic fastener driving device particularly adapted for use in combination with a remote actuation unit as illustrated in FIG. 9.
Figure 32:
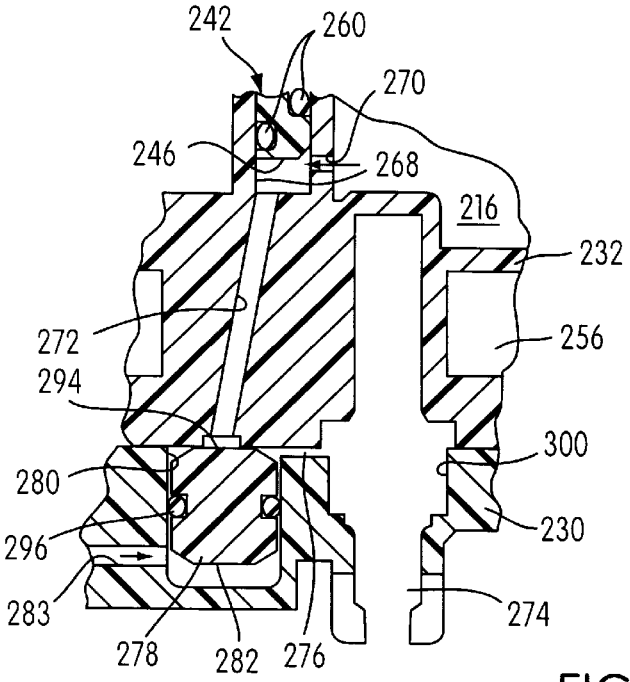
FIG. 32 is a partial sectional view of the valve module shown in FIG. 31, and showing the relative positions of the main valve and secondary valve member when the device is connected to a pressure source but is at rest.

A preferred arrangement for an automatic fastener driving device in combination with the remote actuation unit 401 is shown in FIG. 31. In FIG. 31, like parts are numbered with the same reference numerals as in FIG. 10. It can be appreciated that the automatic device 800 shown in FIG. 31 is substantially identical in structure and function to the automatic device 200 shown in FIG. 10. However, the automatic device 800 differs in that it is provided with a control module 828 which is devoid of any trigger assembly and is also devoid of any actuator stem assembly. Thus, as can be appreciated from FIG. 32, the exhaust port 274 is opened at all times. In FIG. 32, the device is shown in the configuration it assumes when at rest. More specifically, when the device is connected to a pressure source, but is not being activated, the shuttle valve is in an upwards position as the surface 282 receives a high pressure signal. In this upwards position, the shuttle valve 278 is in its closed position preventing communication between passage 272 and the exhaust port 274.

To connect the remote actuation unit 401 with the fastener driving device 200 shown in FIG. 10, the needle valve 286 is replaced with a tapped housing 400. The tapped housing 400 is coupled to the remote actuating unit 401 via flexible hose 402 as shown. The tapped housing 400 is provided with "O"-rings which permanently block passage 264 to create a dead end for the over the piston pressure port, and so that the high/low pressure signal is provided only from the remote unit 401.

With the remote actuating unit 401 in place, the shuttle valve 278 can be remotely actuated by an auxiliary alternating high/low pressure source provided by the remote actuation unit 401 through hose 402. The alternating high and low pressure is received by the surface 282 of shuttle valve 278 through the port 283 for driving the shuttle valve 278. It can be thus appreciated that the surface 282 of the shuttle valve 278 is exposed to the alternating high/low auxiliary pressure source from the remote actuation unit 401 instead of the over-the-piston pressure described with respect to the embodiment shown and described in conjunction with the embodiment of FIG. 10. In the preferred embodiment, when the chamber below surface 282 is exposed to a high pressure signal, the shuttle valve 278 is driven upwards to effect a fastener drive stroke, and when exposed to the low pressure signal the shuttle valve is driven downwards to effect a return stroke. It can be appreciated that in an alternate arrangement, the present invention contemplates that a low signal can be used to effect a drive stroke and a high signal to effect a return stroke.

It should be appreciated that the remote actuation unit 401 may be used in conjunction with the automatic device illustrated in FIG. 10, which includes a trigger assembly and actuating stem assembly, although this is not preferred. If the control module 228 provided in the fastener driving device 200 shown in FIG. 10 is used, the trigger member 316 must be held in an operating or depressed position by a latch or clip member (not shown) for remote, non-manual, automatic operation. It can thus be appreciated that more parts would be required in comparison with the embodiment shown in FIG. 31.

FIGS. 21–32 show the pneumatically operated fastener driving device in accordance with the present invention when used with a full-cycle control module.

The fastener driving device, generally indicated at 410, includes the usual housing assembly, generally indicated at 412, having a cylindrical housing portion 413 and a frame housing portion 415, extending laterally from the cylindrical housing portion 413. A hand grip portion 414 of hollow configuration is defined in the frame housing portion 415, which constitutes a reservoir chamber 416 for air under pressure coming from a source which is communicated therewith. The housing assembly 412 further includes the usual nose piece defining a fastener drive track 418 which is adapted to receive laterally therein the leading fastener from a package of fasteners mounted within a magazine assembly 420 of conventional construction and operation.

Mounted within the cylindrical housing portion 413 is a cylinder 422 which has its upper end disposed in communicating relation with the reservoir chamber 416 via passageway 424. Mounted within the cylinder 422 is a piston 426. Carried by the piston 426 is a fastener driving element 428 which is slidably mounted within the drive track and movable by the piston and cylinder unit through a cycle of operation which includes a drive stroke during which the fastener driving element 428 engages a fastener within the drive track and moves the same longitudinally outwardly into a workpiece, and a return stroke.

Means is provided within the housing assembly 412 to effect the return stroke of the piston 426. For example, such means may be in the form of a conventional plenum chamber return system such as disclosed in U.S. Pat. No. 3,708,096, the disclosure of which is hereby incorporated by reference into the present specification.

In order to effect the aforesaid cycle of operation, there is provided a control module or "control valve structure", generally indicated at 430, constructed in accordance with the present invention. The control module 430 includes a housing unit, which, in the illustrated embodiment includes a trigger housing 432 removably coupled to the frame portion 415 by pin connections at 434, and a valve housing 436 secured to the trigger housing 432 by fasteners, preferably in the form of screws 438. Housings 432 and 436 are preferably molded from plastic material. O-rings 440 and 442 seal the valve housing 436 within the frame portion of the housing assembly 412.

Figures 10, 21:
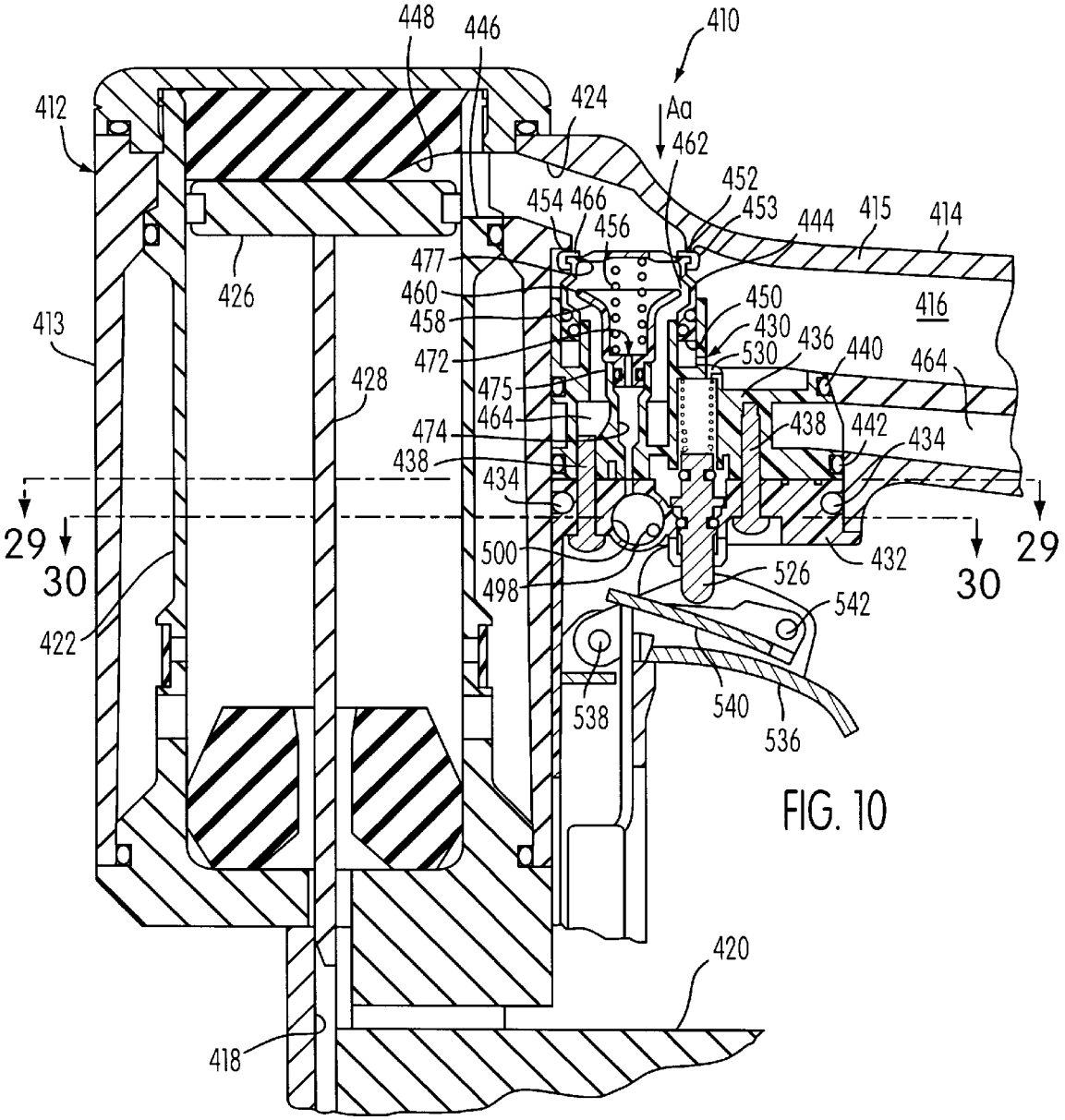
FIG. 21 is a partial sectional view of a fastener driving device including a full cycle control valve module provided in accordance with the present invention.

Referring now more particularly to FIG. 21, in the illustrated embodiment, the control module 430 includes a main valve 444 mounted with respect to the valve housing 436 and associated with the passageway 424 between one end 446 of the cylinder 422, and the reservoir chamber 416. The main valve 444 is moveable between opened and closed positions to open and close the passageway 424 and has a first annular pressure responsive surface 450 and a second, opposing annular pressure responsive surface 452. When the main valve 444 is closed, a portion 453 of surface 452 extends beyond annular housing seat 454 and is exposed to reservoir pressure in the reservoir chamber 416. Spring structure, in the form of a coil spring 456 biases the main valve 444 to its closed position, together with reservoir pressure acting on surface 450. Thus, the force of the spring 456 plus the force due to pressure acting on surface 450 is greater than the force due to pressure acting on the portion 453 of the opposing surface 452, which results in the keeping the main valve 444 in its closed position. The spring 456 is disposed between a surface of an exhaust seal 458 and a surface of the main valve 444. The exhaust seal 458 is fixed to the valve housing 436 and an upper annular surface 460 thereof contacts an inner surface of the main valve 444 when the main valve is in its fully opened position, thereby closing an exhaust path 462. Exhaust path 462 communicates with the atmosphere via the exhaust 464.

A urethane seal member 466 is attached to the upper end of the main valve 444 and ensures proper sealing when the main valve 444 is closed. Thus, when the main valve 444 is in its closed position, surface 452 and thus seal member 466 of the main valve is in sealing engagement with seat 454 of the housing assembly 412. O-ring seals 470 (FIG. 23) are provided for sealing the main valve 444 within the valve housing 436.

A passageway, generally indicated at 472, is defined through the main valve 444 and the exhaust seal 458. The passageway 472 includes passage 474 of the valve housing 436, passage 476 of the trigger housing 432, passage 475 of the exhaust seal 458 and passages 477 defined in the top surface of the main valve 444. The passageway 472 is part of second passage structure which provides a pressure signal to the secondary valve structure, as will become apparent below.

A pressure chamber 478 (FIG. 22) is defined between the first pressure responsive surface 450 of the main valve 444, and a portion of the valve housing 436. The pressure chamber 478 is in communication with the high pressure in reservoir chamber 416 via a feed orifice 480 to bias the main valve 444 to its closed position. This high pressure in chamber 478 is dumped to atmosphere to open the main valve 444, as will be explained below.

Figure 22:
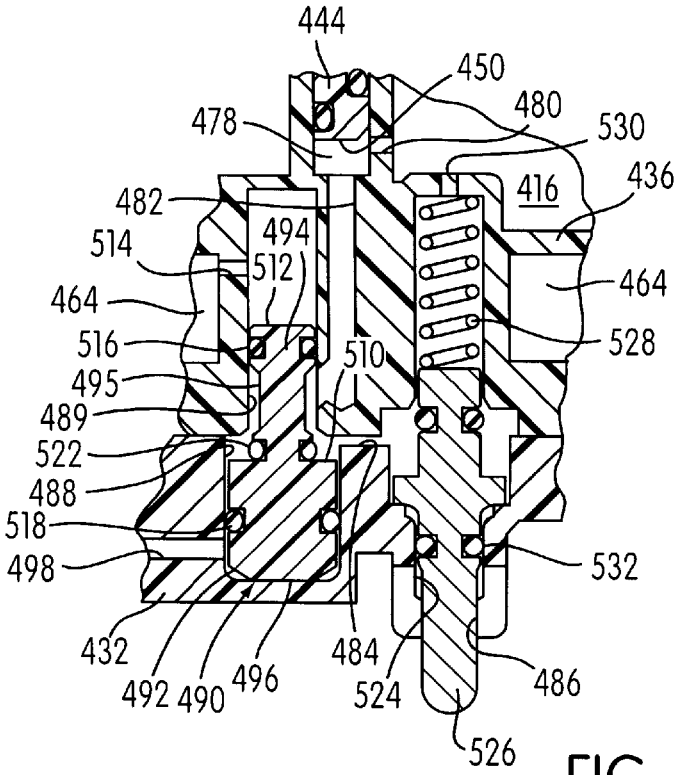
FIG. 22 is a partial sectional view of the control module of FIG. 21 showing the relative positions of the main valve and secondary valve member when the device is at rest.

With reference to FIG. 22, first passage structure connects the pressure chamber 478 with an exhaust port 486. Passage 482, bores 488 and 489, bleed path 484 define the first passage structure between the pressure chamber 478 and the exhaust port 486, the function of which will be apparent below. It can be appreciated that the first passage structure may be of any configuration which permits communication between the pilot pressure chamber 478 and the exhaust port 486.

The control module 430 includes a secondary valve member in the form of a shuttle valve 490 mounted with respect to the first passage structure in bore 488 of trigger housing 432 and bore 489 of valve housing 436 (FIG. 22). FIG. 22 shows the position of the shuttle valve 490 when the device 410 is at rest. The shuttle valve 490 is generally cylindrical and has a base portion 492 and a stem portion 494 extending from the base portion 492. The stem portion 494 has a reduced diameter portion 495, the function of which will become apparent below. The base portion 492 defines a first pressure receiving surface 496 which is in pressure communication with over-the-piston pressure, which is the pressure communicating with a piston chamber 448. This pressure may be exhaust pressure or high pressure, depending on what part of the cycle the device 410 is operating. Such communication is achieved since surface 496 communicates with port 498, which in turn communicates with bore 500, which is in communication with the passageway 472. The passageway 472 is open to passage 424 and thus open to the piston chamber 448. These passages define second passage structure providing communication between the shuttle valve 490 and the piston chamber 448. It can be appreciated that the second passage structure can be of any configuration which permits communication between the piston chamber and the secondary valve member.

In the illustrated embodiment, a plug 502 (FIG. 30) is sealingly mounted in bore 500. When the valve housing 436 is coupled to the trigger housing 432, a pressure cavity 504 is defined. Port 506 is in communication with cavity 504 (FIG. 29) and communicates the pressure cavity 504 with the port 498 via bore 500. A seal member 508 provides a seal between the trigger housing 432 and the valve housing 436.

The shuttle valve 490 has a second pressure receiving surface 510 opposing the first pressure receiving surface 496 and in communication with the reservoir chamber 416 via passage 482 and the feed orifice 480. When the device 410 is at rest, reservoir pressure via port 530 also communicates with surface 510. Further, the stem portion 494 of the shuttle valve 490 includes a third pressure receiving surface 512 continuously exposed to the atmosphere via port 514. The surface area of annular surface 510 and annular surface 512 are each less than the surface area of annular surface 496. Port 514 communicates with the exhaust 464. As shown in FIG. 22, when the shuttle valve 490 is in its opened position normally biased by high pressure at surface 510, communicated through passage 482 via feed orifice 480 and via port 530, passage 482 communicates with the bleed path 484. This occurs since the high pressure air may pass around the reduced diameter portion 495 of the shuttle valve 490. An o-ring 516 prevents this high pressure air from escaping to atmosphere through port 514 while o-ring 518 isolates the passage 482 from port 498. Surface 496 is exposed to atmospheric pressure since over-the-piston pressure in port 498 is atmospheric pressure due to the exhaust path 462 being open.

Figure 23:
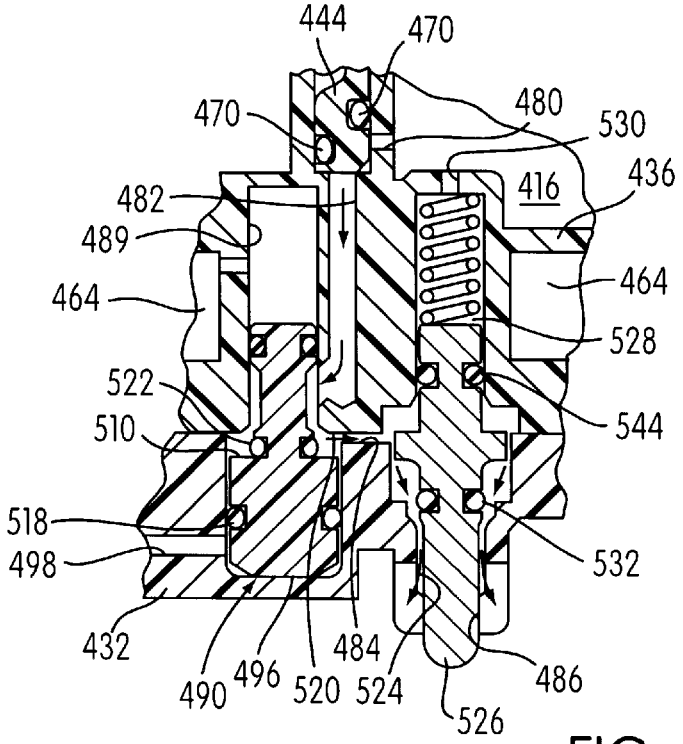
FIG. 23 is a sectional view similar to FIG. 22, showing an actuating member actuated moving the main valve to an opened position.
Figure 24:
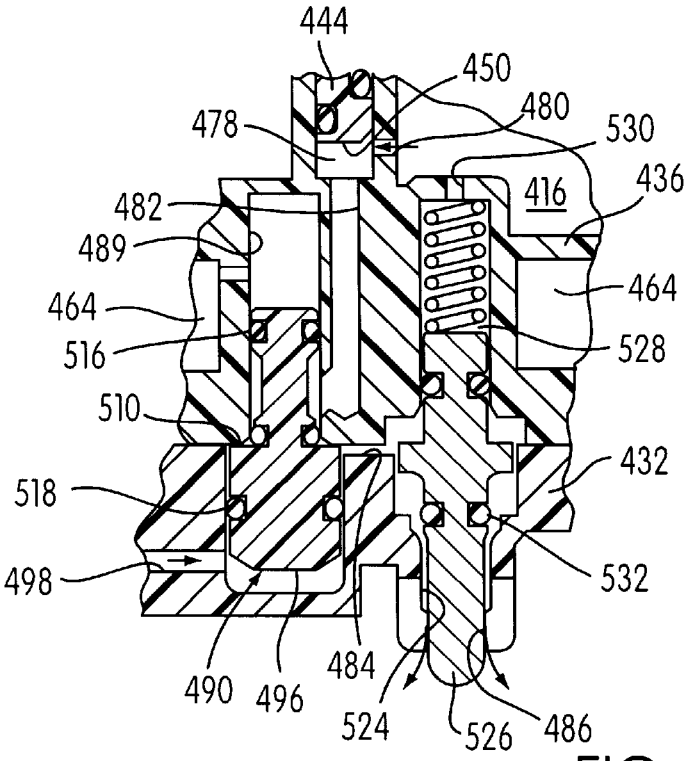
FIG. 24 is a view similar to FIG. 22, showing the main valve and secondary valve member in closed positions during a return stroke of the piston while the actuating member remains actuated.

With reference to FIG. 23, when the device 410 is actuated as explained more fully below, pressure in the pilot pressure chamber 478 is exhausted and port 530 is sealed, thereby permitting the main valve to open, initiating a fastener drive stroke. As a result, over-the-piston pressure or high pressure acts on surface 496 imposing a greater force than a force acting on surface 510 due to pressure communicating therewith; thus, the shuttle valve 490 is moved to its closed position (FIG. 24). In this position, surface 510 of the shuttle valve 490 engages surface 520 of the valve housing 436 so as to prevent communication between port 482 and the exhaust port 486. O-ring 516 seals off surface 512 and both O-rings 516 and 522 seal off port 482 creating a pneumatically balanced seal. O-ring 522 seals off port 486. Also, o-ring 518 prevents pressure in port 498 from communicating with the exhaust port 486. When the shuttle valve 490 is in this closed position, feed orifice 480 pressurizes pilot pressure chamber 478, closing the main valve, as will be explained in more detail below.

As shown in FIG. 22, the bleed path 484 connects the passage 482 and bores 488 and 489 with a trigger stem bore 524. The trigger stem bore 524 communicates with the exhaust port 486 and may be considered part of the exhaust port. A trigger stem 526, defining an actuator, is carried by the trigger housing 432 for movement from a normal, sealed position into an operative, unsealed position for initiating movement of the main valve 444 to its opened position, thereby initiating movement of the fastener driving element 428 through a fastener drive stroke. The actuator 526 is normally biased to its normal, sealed position by a spring 528, together with reservoir pressure exerted thereon via trigger port 530. Port 530 communicates with reservoir chamber 416. As shown in FIG. 22, in the sealed position, the actuator 526 engages a surface of the trigger housing 432 with an O-ring 532 compressed therebetween, sealing the exhaust port 486.

With reference to FIG. 21, in the illustrated embodiment, the control module 430 includes a trigger assembly including a trigger member 536 pivoted to the trigger housing 432 at pin 538 for manual movement from a normal, inoperative position into an operative position. The trigger assembly also includes a rocker arm 540 which is pivoted to the trigger member 536 via a pin 542. Upward movement of the trigger member 536 causes the rocker arm 540 to engage and move the actuator 526 from its sealed position to its operative, unsealed position.

The operation of the control module and thus the device 410 will be appreciated with reference to FIGS. 21–30. As shown in FIG. 22, when the device 410 is at rest, reservoir pressure from feed orifice 480 acting on surface 450 biases the main valve 444 against seat 454 of the housing assembly 412 preventing reservoir pressure from entering the upper end 446 of the cylinder 422. The main valve 444 is biased upwardly since the area of pressure responsive surface 450 is greater than the surface area of portion 453 (FIG. 21) extending beyond seat 454. High pressure in chamber 478 enters the passage 482 and bores 488 and 489 and biases the shuttle valve 490 to its opened position together with reservoir pressure from port 530. Thus, high pressure exerted on surface 510 of the shuttle valve 490 opens the shuttle valve. Pressure in port 498 is exhausting pressure since the piston chamber 448 is exposed to atmospheric pressure via the passageway 472 and the exhaust path 462. The actuating member 526 is biased to its normal, sealed position with exhaust port 486 closed.

As shown in FIG. 23, when the actuator 526 is moved upwardly by manual movement of the trigger member 536, exhaust port 486 is opened which dumps the pressure in the pilot pressure chamber 478 to atmosphere via the passage 482, bores 488 and 489 and bleed path 486. This causes the main valve 444 to shift to its opened position as shown in FIG. 23, permitting the high pressure to pass through passageway 424 and into the piston chamber 448 to cause the fastener driving element 428 to move through a drive stroke. The actuator 526 includes an upper o-ring 544 which seals off reservoir pressure directed from port 530 before the o-ring 532 is unsealed with respect to the trigger stem bore 524. At this time, over-the-piston pressure is high pressure which passes through the passageway 472 and into port 498. As shown in FIG. 23, when the main valve 444 is opened fully, the force created by high pressure acting on pressure surface 452 (FIG. 21) is greater than the force of the spring 456 at its compressed height plus the force created by atmospheric pressure acting on surface 450. In this position and with reference to FIG. 21, it can be appreciated that the main valve 444 engages the annular surface 460 of the exhaust seal 458 which closes passageway 462 preventing pressure in the piston chamber 448 from exiting the device 410 through the exhaust 464.

Over-the-piston pressure air or high pressure air bleeds through the passageway 472 into bore 500 and through port 498 under the shuttle valve 490 and into port 506 and thus into cavity 504. Cavity 504 provides a volume for air to build which controls piston dwell at the bottom of its stroke. Cavity 504 provides adequate dwell to decay pressure in pilot pressure clamber 478. Over-the-piston pressure air builds in cavity 504 and communicates with surface 496 of the shuttle valve 490 via port 498, thus, shifting the shuttle valve 490 to its closed position, as shown in FIG. 24. This occurs since force created by over-the-piston pressure acting on surface 496 is greater than pressure acting on surface 510 and the atmospheric pressure acting on surface 512. Thus, as shown in FIG. 24, with the actuator 526 still actuated, during the return stroke of the fastener driving element, the over-the-piston pressure or high pressure in passage 498 shifts the shuttle valve 490 to its closed position preventing communication between passage 482 and the exhaust port 486. Chamber 478 is filled with reservoir pressure via feed orifice 480. The feed orifice is sized to control the piston dwell at the bottom of its stroke. High pressure air then shifts the main valve 444 to its closed position such that seal member 466 is engaged with seat 454 of the housing assembly 412 (FIG. 21). Over-the-piston pressure exhausts through path 462 and through the exhaust 464. Over-the-piston pressure in cavity 504 bleeds through port 506 (FIG. 29) and then through passage 476 and through passageway 472, through path 462 and finally bleeds out through the exhaust 464. As noted above, the configuration of the shuttle valve 490 and o-rings 516 and 522 provides a pneumatically balanced seal. Thus, once the shuttle valve 490 is closed, it remains closed until the trigger member is released, as explained below.

Figure 25:
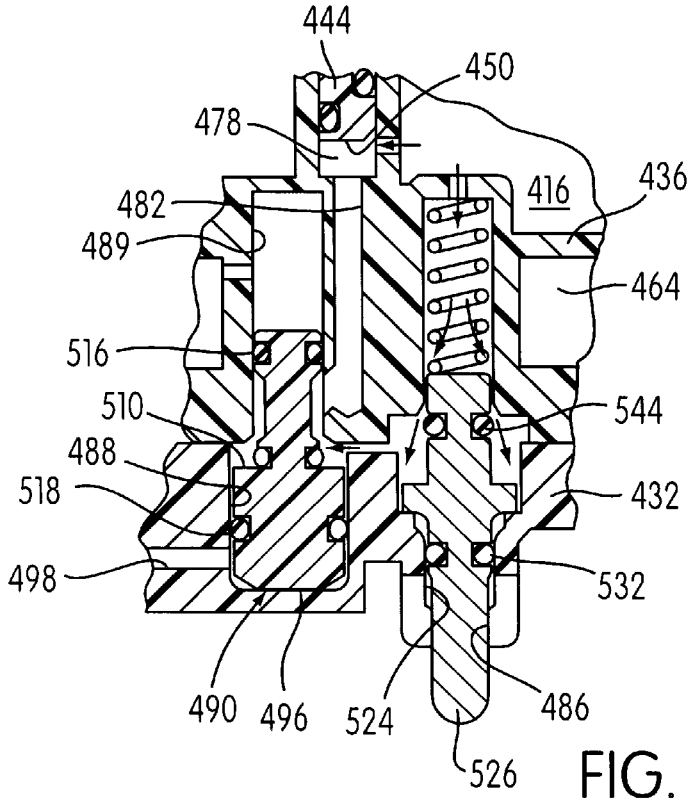
FIG. 25 is a view similar to FIG. 22, showing the actuating member released, with the main valve disposed in the closed position thereof and the secondary valve member returned to the opened position thereof.
Figure 26:
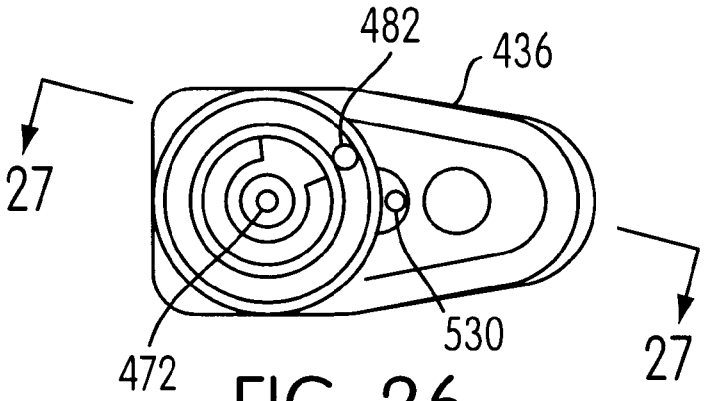
FIG. 26 is a view of a portion of the control valve module as seen in the direction of arrow Aa of FIG. 21, shown with the main valve removed for clarity of illustration.
Figure 27:
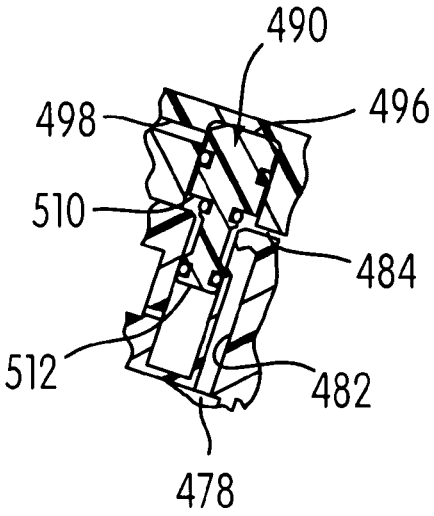
FIG. 27 is a partial sectional view taken along the line 27—27 of FIG. 26, showing the secondary valve member in an opened position.
Figure 28:
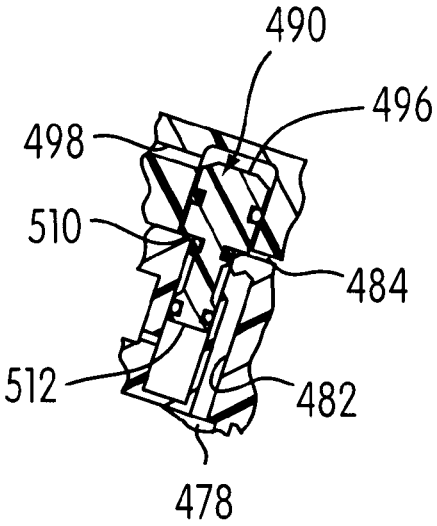
FIG. 28 is a partial sectional view taken along the line 27—27 in FIG. 26, showing the secondary valve member in a closed position.
Figure 29:
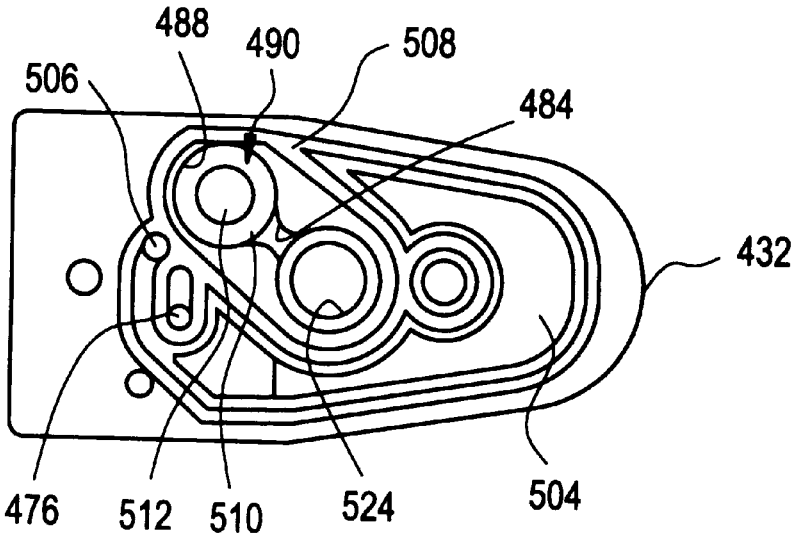
FIG. 29 is a view of the trigger housing of the control valve module taken along the line 29—29 of FIG. 21.
Figure 30:
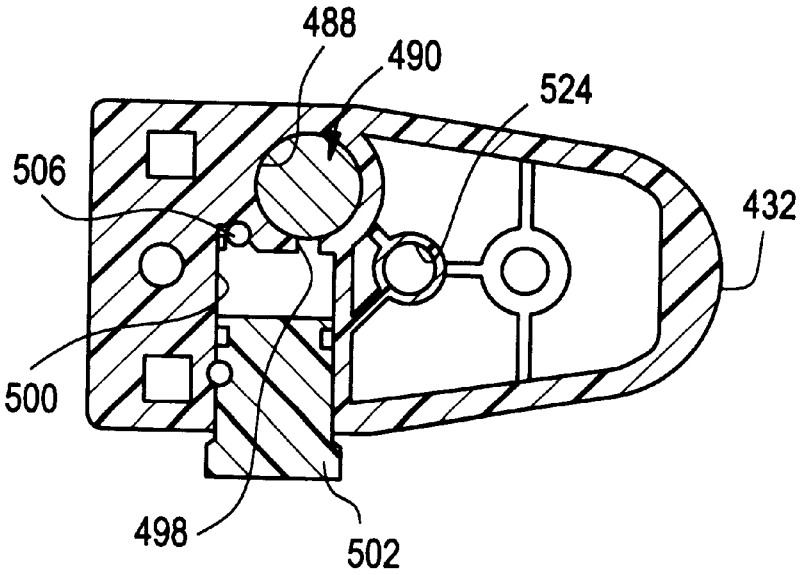
FIG. 30 is a sectional view taken along the line 30—30 of FIG. 21.

With reference to FIG. 25, release of the trigger member 536 permits the actuator 526 to move to its sealed position. This causes high pressure air to bleed past o-ring 544 and be exerted on surface 510 of the shuttle valve 490, thereby biasing or resetting the shuttle valve 490 to its opened position, with the main valve 444 in the closed position thereof, as shown in FIG. 25. Over-the-piston pressure in passage 498 and under the shuttle valve 490 is exhaust pressure since the main valve 444 is closed and the exhaust path 462 is opened. Thus, it can be appreciated that one full cycle is completed while the trigger member 536 is actuated. Release of the trigger member 536 resets the shuttle valve 490 and the device 410 is ready to be actuated again.

It can be appreciated that by positioning the main valve 444 in the frame of the device 410, the overall tool height is reduced. Further, since in the illustrated embodiment, the control module 430 is in the form of a single unit, removable from the housing 412, the device 410 is easy to assembly and service.

It can also be appreciated that the main valve and shuttle valve may be arranged in various positions with respect to the control module and may have various configurations, yet perform the same function as disclosed above.

It can thus be seen that the main valve and shuttle valve arrangement ensures that one full cycle of operation is completed while the trigger member remains actuated. Release of the trigger member resets the device 410 for another full cycle. Since the fastener driving element is only exposed for a very brief time to drive the fastener, damage to the fastener driving element may be prevented, even if the operator holds the trigger for a time longer than necessary to drive the fastener. Further, after the drive stroke, pressure over the piston will not reach line pressure with the trigger member actuated. Thus, exhausting the pressure over the piston during the return stroke results in quieter tool operation.

It should be appreciated that while the present application discloses the interchangeability of four (standard, full cycle, automatic, and automatic with remote) types of control modules for the pneumatically operated fastener driving device of the present invention, the present invention requires the interchangeability of only two or more type of control modules. For example, in the broadest aspect of the present invention, it is only required that there need be one possible control module substitute for the initial control module positioned in the main frame portion. In the preferred embodiment, however, interchangeability of all four types of control modules is possible.

It should also be appreciated that the main valve 46 of the standard control module shown in FIG. 1, main valve 242 of the automatic control module shown in FIG. 10, and main valve 444 of the full cycle control module shown in FIG. 21 are preferably identical in structure so that failure of any one of the main valves noted above can be easily replaced by the same structure, thereby reducing inventory costs. In fact, if the main valve of one control module fails, it may be replaced simply by scavenging a main valve from one of the different types of interchangeable control modules on hand. The main valves are easily removed simply by removing the associated control module from the main frame and pulling the main valve from the annular groove portion (e.g., reference numeral 64 in FIG. 2) in which it is seated and replacing it by positioning another main valve in the annular groove portion.

While the invention has been described in connection with what is presently considered to be the most practical and preferred embodiment, it is understood that the invention is not limited to the disclosed embodiment, but on the contrary, is intended to cover various modifications and equivalent arrangements included within the spirit and scope of the appended claims.

What is claimed is:

1. A pneumatically operated fastener driving device comprising:

a housing having a tubular housing portion and a main frame portion extending laterally from said tubular housing portion, said tubular housing portion defining a fastener drive track, a fastener magazine for feeding successive fasteners laterally into the drive track, a fastener driving element slidably mounted in the drive track for movement through an operative cycle including a drive stroke during which a fastener within the drive track is engaged and moved longitudinally outwardly of the drive track into a workpiece and a return stroke, a drive piston connected with the fastener driving element, a cylinder, defined in said tubular housing portion, within which the piston is reciprocally mounted, an air pressure reservoir communicating with one end of the cylinder through a passageway, a control module for opening said passageway and communicating reservoir pressure with the cylinder at said one end thereof to move the piston in a direction to effect the drive stroke of the fastener driving element and for closing said passageway and communicating the one end of the cylinder with atmosphere for permitting the piston to move in a direction to effect the return stroke of the fastener driving element, said control valve module including:

a control module housing assembly mounted with respect to said main frame portion of said housing and providing an exhaust passage which can be opened to communicate the one end of the cylinder with atmosphere, a main valve mounted with respect to said control module housing assembly for movement between opened and closed positions to open and close said passageway, said main valve having a first pressure area defining with a portion of said control module housing assembly a control pressure chamber, said main valve including a second pressure area in opposing relation to said first pressure area, spring structure biasing said main valve towards its closed position, exhaust seal structure fixed to said control module housing assembly, said exhaust seal being operatively associated with said main valve for closing said exhaust passage when said main valve is disposed in its opened position, an actuating member mounted with respect to said control module housing assembly and being constructed and arranged to move from a normal, sealed position into an operative, unsealed position for initiating movement of said main valve to its opened position thereby opening said passageway and initiating movement of the fastener driving element through a fastener drive stroke, and a trigger assembly mounted with respect to said control module housing assembly for movement from a normal, inoperative position into an operating position, such that movement of said trigger assembly from its inoperative position to its operating position moves said actuating member from its normal, sealed position to its operative, unsealed position, said actuating member controlling pressure in said control pressure chamber such that when said actuating member is in its operative, unsealed position, pressure in said control pressure chamber acting on said first pressure area is released to atmosphere and pressure acting on said second pressure area moves said main valve against the bias of said spring structure to its opened position initiating a fastener drive stroke, said main valve engaging said exhaust seal structure when said main valve is in its opened position thereby closing said exhaust passage and preventing said one end of said cylinder to communicate with atmosphere, said control module being operable to effect movement of said fastener driving element from an initial position through a fastener drive stroke, and though a return stroke wherein said fastener driving element returns to said initial position after said fastener drive stroke, said control module being a selected one of the following types:

a) a first type of control module operable to effect movement of said fastener driving element from said initial position through one said fastener drive stroke upon movement of said trigger assembly from said normal inoperative position into said operating position, and wherein upon return of said trigger assembly from said operating position to said normal inoperative position said fastener driving element moves though said return stroke wherein said fastener driving element returns to said initial position, b) a second type of control module operable to effect movement of said fastener driving element through one full cycle fastener driving stroke including said fastener drive stroke and said return stroke upon movement of said trigger assembly from said normal inoperative position into said operating position, c) a third type of control module operable to effect movement of said fastener driving element through a plurality of alternating fastener drive strokes and return strokes upon movement of said trigger assembly from said normal inoperative position into said operating position, and to terminate said alternating fastener drive strokes and return strokes upon movement of said trigger assembly from said operating position to said normal inoperative position, d) a fourth type of control module constructed and arranged to be connected with a remote actuation unit providing alternating high and low pressure signals to said fourth type of control module to effect alternating fastener drive strokes and return strokes, said selected one control module being constructed and arranged with respect to said main frame portion of said housing so as to be removable therefrom as a unit, and wherein after removal of said selected one control module as a unit, another one of said types of control modules can be positioned with respect to said main frame portion of said housing as a unit to as to be operable therewith.

2. The pneumatically operated fastener driving device according to claim 1, wherein said main frame portion defines an annular seating surface, said main valve including an annular surface which engages said seating surface when said main valve is in its closed position, and when said main valve is in its closed position, said second pressure area being defined as an area extending beyond said annular seating surface and exposed to reservoir pressure in said pressure reservoir.

3. The pneumatically operated fastener driving device according to claim 2, wherein at least a portion of said annular surface of said main valve includes a urethane seal member thereon.

4. The pneumatically operated fastener driving device according to claim 1, wherein said exhaust seal structure includes an annular valve element constructed and arranged to close said exhaust passage when said main valve is disposed in its opened position, said exhaust seal structure and said control module housing assembly being constructed and arranged such that said exhaust passage extends between said valve element and said main valve and through a portion of said control module housing assembly, said main valve including at least one port in an upper surface thereof communicating said one end of the cylinder with said exhaust passage.

5. The pneumatically operated fastener driving device according to claim 4, wherein said exhaust seal structure is disposed within an interior portion of said main valve such that when said main valve moves to its opened position, an inner peripheral surface of said main valve engages said valve element of said exhaust seal structure to close said exhaust passage preventing said one end of the cylinder from communicating with the atmosphere.

6. The pneumatically operated fastener driving device according to claim 1, wherein said control module housing assembly includes:

a valve housing, said main valve being mounted with respect to said valve housing, and a trigger housing coupled to said valve housing, said trigger assembly being coupled to said trigger housing.

7. The pneumatically operated fastener driving device according to claim 6, wherein said valve housing is coupled to said trigger housing by fasteners and said trigger housing is coupled to said main frame portion of said housing by a pin connection so as to fix said control module to said main frame portion of said housing.

8. The pneumatically operated fastener driving device according to claim 1, wherein said actuating member is biased to its normal, sealed position by reservoir pressure and a spring force, said reservoir pressure communicating with said actuating member via a feed orifice, said feed orifice being sized to control dwell of said piston at a bottom of its stroke.

9. The pneumatically operated fastener driving device according to claim 1, wherein said control module is coupled to said main frame portion of said housing by a removable pin connection which fixes said control module housing assembly to said main frame portion of said housing.

10. A pneumatically operated fastener driving device according to claim 1, wherein said second type of control module comprises:

a first passage structure between the control pressure chamber and the exhaust passage, a pressure responsive secondary valve member movable between a normally opened position and a closed position, second passage structure communicating said one end of the cylinder with said second valve member, said second passage structure communicating with said exhaust passage when said exhaust passage is in an opened condition, said secondary valve member being mounted with respect to said first passage structure so as to be movable between an opened position biased by air under pressure via said first passage structure permitting communication between said control pressure chamber and said exhaust passage, and a closed position biased by air over the drive piston communicated from said one end of the cylinder via said second passage structure preventing communication between said control pressure chamber and said exhaust passage, an operative cycle being initiated upon movement of said trigger member to its operating position which moves said actuator to its unsealed position exhausting control pressure in said control pressure chamber through said exhaust passage and causing said main valve to move to its opened position thereby initiating the fastener drive stroke, pressure over said drive piston in said piston chamber and said second passage structure communicating with said second valve member to move said secondary valve member from the opened position thereof to the closed position thereof causing said main valve to move to its closed position thereby completing one said operative cycle while said trigger member remains in the operating position thereof, said secondary valve member being constructed and arranged to return to the opened position thereof when said trigger member is permitted to move to the normal inoperative position thereof.

11. A pneumatically operated fastener driving device according to claim 1, wherein said third type of control module comprises:

first passage structure between the pilot pressure chamber and the exhaust passage, a secondary valve member mounted with respect to said first passage structure so as to be movable between an opened position biased by air under pressure permitting communication between said control pressure chamber and said exhaust passage, and a closed position biased by air over the drive piston at said one end of the cylinder preventing communication between said control pressure chamber and said exhaust passage, second passage structure communicating said one end of the cylinder with said secondary valve member and with said exhaust passage, whereby an operative cycle is initiated upon movement of said trigger member to its operating position which moves said actuator to its unsealed position exhausting control pressure in said control pressure chamber and causing said main valve to move to its opened position thereby initiating the fastener drive stroke, pressure over said drive piston at said one end of the cylinder communicating with said secondary valve member to move said secondary valve member to its closed position preventing communication between said control pressure chamber and said exhaust passage thereby causing said main valve to move to its closed position, said secondary valve member being constructed and arranged to move in response to changes in pressure occurring at said one end of the cylinder to cause said main valve to reciprocate thereby causing said drive piston to move through repeated fastener driving and return strokes as long as said trigger member is in its operative position.

12. The pneumatically operated fastener driving device according to claim 11, further comprising a valve disposed in said second passage structure constructed and arranged to restrict air flow in said second passage structure thereby controlling piston dwell at the top of the piston stroke.

13. The pneumatically operated fastener driving device according to claim 12, wherein said valve is a manually moveable needle valve.

14. The pneumatically operated fastener driving device according to claim 1, further including a spring biasing said actuator to its normal, sealed position together with said air under pressure, said actuator including a seal member which seals said exhaust passage when said actuator is in its sealed position.

15. The pneumatically operated fastener driving device according to claim 1, wherein said third type of control module is operable in combination with a remote actuation unit constructed and arranged to be pneumatically coupled to said housing assembly so as to move said secondary valve member remotely.

16. The pneumatically operated fastener driving device according to claim 1, wherein said fourth type of control module is constructed and arranged such that said high pressure signals effect said fastener driving strokes and said low pressure signals effect said return strokes.

17. A pneumatically operated fastener driving device comprising:

a housing;

a fastener drive track disposed within said housing, a fastener magazine for feeding successive fasteners laterally into the drive track, a fastener driving element slidably mounted in the drive track for movement through an operative cycle including a drive stroke during which a fastener within the drive track is engaged and moved longitudinally outwardly of the drive track into a workpiece and a return stroke, a drive piston connected with the fastener driving element, a cylinder, defined in said housing, within which the piston is reciprocally mounted, an air pressure reservoir communicating with one end of the cylinder through a passageway, a control module for opening said passageway and communicating reservoir pressure with the cylinder at said one end thereof to move the piston in a direction to effect the drive stroke of the fastener driving element and for closing said passageway and communicating the one end of the cylinder with atmosphere for permitting the piston to move in a direction to effect the return stroke of the fastener driving element, said control valve module including i) a control module housing assembly mounted with respect to said housing and providing an exhaust passage which can be opened to communicate said one end of the cylinder with atmosphere, and ii) a main valve mounted with respect to said control module housing assembly for movement between opened and closed positions to open and close said passageway, said control module being operable to effect movement of said fastener driving element from an initial position through a fastener drive stroke, and though a return stroke wherein said fastener driving element returns to said initial position, said control module being a selected one of the following types:

a) a first type of control module having a trigger assembly operable to effect movement of said fastener driving element from said initial position through one said fastener drive stroke upon movement of said trigger assembly from said normal inoperative position into said operating position, and wherein upon return of said trigger assembly from said operating position to said normal inoperative position said fastener driving element moves though said return stroke wherein said fastener driving element returns to said initial position, b) a second type of control module having a trigger assembly operable to effect movement of said fastener driving element through one full cycle fastener driving stroke including said fastener drive stroke and said return stroke upon movement of said trigger assembly from said normal inoperative position into said operating position, c) a third type of control module having a trigger assembly operable to effect movement of said fastener driving element through a plurality of alternating fastener drive strokes and return strokes upon movement of said trigger assembly from said normal inoperative position into said operating position, and to terminate said alternating fastener drive strokes and return strokes upon movement of said trigger assembly from said operating position to said normal inoperative position, d) a fourth type of control module which is devoid of a trigger assembly and constructed and arranged to be connected with a remote actuation unit providing alternating high and low pressure signals to effect alternating fastener drive strokes and return strokes, said selected one control module being constructed and arranged with respect to said main frame portion of said housing so as to be removable therefrom as a unit, and wherein after removal of said selected one control module as a unit, another one of said types of control modules can be positioned with respect to said main frame portion of said housing as a unit to as to be operable therewith.

18. The pneumatically operated fastener driving device according to claim 17, wherein said main valve has a first pressure area defining with a portion of said control module housing assembly a control pressure chamber, said main valve including a second pressure area in opposing relation to said first pressure area, and further comprising:

spring structure biasing said main valve towards its closed position, exhaust seal structure fixed to said control module housing assembly, said exhaust seal structure being operatively associated with said main valve for closing said exhaust passage when said main valve is disposed in its opened position.

19. The pneumatically operated fastener driving device according to claim 18, further comprising:

an actuating member mounted with respect to said control module housing assembly and being constructed and arranged to move from a normal, sealed position into an operative, unsealed position for initiating movement of said main valve to its opened position thereby opening said passageway and initiating movement of the fastener driving element through a fastener drive stroke, and said trigger assembly of said first type, said second type, and said third type of control modules mounted with respect to said control module housing assembly for movement from a normal, inoperative position into an operating position, such that movement of said trigger assembly from its inoperative position to its operating position moves said actuating member from its normal, sealed position to its operative, unsealed position, said actuating member controlling pressure in said control pressure chamber such that when said actuating member is in its operative, unsealed position, pressure in said control pressure chamber acting on said first pressure area is released to atmosphere and pressure acting on said second pressure area moves said main valve against the bias of said spring structure to its opened position initiating a fastener drive stroke, said main valve engaging said exhaust seal structure when said main valve is in its opened position thereby closing said exhaust passage and preventing said one end of said cylinder to communicate with atmosphere.

20. The pneumatically operated fastener driving device according to claim 17, wherein said main valve is removable from said control module housing assembly for each of said types of control modules, and wherein said main valve of each of said types of control modules are interchangeable with said main valve of all other of said types of control modules.

21. The pneumatically operated fastener driving device according to claim 17, wherein each of said first type of control module, said second type of control module, said third type of control module, and said fourth type of control module can be interchangeably mounted with respect to said main frame portion of said housing so as to be operable therewith.

22. The pneumatically operated fastener driving device according to claim 17, wherein said fourth type of control module is constructed and arranged such that said high pressure signals effect said fastener driving strokes and said low pressure signals effect said return strokes.

* * * * *